US010034564B2

(12) United States Patent
Sims

(10) Patent No.: US 10,034,564 B2
(45) Date of Patent: Jul. 31, 2018

(54) LOCKABLE BEVERAGE CONTAINER CLOSURE

(71) Applicant: Pacific Market International, LLC, Seattle, WA (US)

(72) Inventor: Randy Sims, Franklin, TN (US)

(73) Assignee: Pacific Market International, LLC, Seattle, WA (US)

( * ) Notice: Subject to any disclaimer, the term of this patent is extended or adjusted under 35 U.S.C. 154(b) by 0 days.

(21) Appl. No.: 14/959,246

(22) Filed: Dec. 4, 2015

(65) Prior Publication Data

US 2016/0081502 A1 Mar. 24, 2016

Related U.S. Application Data

(63) Continuation of application No. 14/321,675, filed on Jul. 1, 2014, now Pat. No. 9,282,838.

(51) Int. Cl.
*B65D 51/18* (2006.01)
*A47G 19/22* (2006.01)
(Continued)

(52) U.S. Cl.
CPC ..... *A47G 19/2272* (2013.01); *B65D 41/04* (2013.01); *B65D 43/02* (2013.01); *B65D 43/0225* (2013.01); *B65D 43/0229* (2013.01); *B65D 43/26* (2013.01); *B65D 47/0871* (2013.01); *B65D 47/32* (2013.01); *B65D 51/18* (2013.01); *B65D 55/02* (2013.01);
(Continued)

(58) Field of Classification Search
CPC ..... A47G 19/2272; B65D 43/0225; B65D 51/18; B65D 47/32; B65D 43/0229; B65D 47/0871; B65D 43/02; B65D 43/26; B65D 55/02; B65D 41/04; B65D 2251/009; B65D 2251/0081; B65D 2251/0028; B65D 2543/00972; B65D 2543/0049; B65D 2543/00546; B65D 2205/02; B65D 2543/00092; B65D 2543/00231; B65D 2251/0018; B65D 2251/0015; B65D 2543/00046
USPC ..... 220/256.1, 259.1, 259.3, 259.4, 263, 220/254.2, 254.3, 254.6; 215/201–225, 215/228, 235–237, 273, 277
See application file for complete search history.

(56) References Cited

U.S. PATENT DOCUMENTS 4,203,527 A * 5/1980 LaChance, Sr. ..... B65D 50/045 220/253
5,738,236 A * 4/1998 Brun, Jr. ..... B65D 47/265 215/309
(Continued)

*Primary Examiner* — Kareen Thomas
(74) *Attorney, Agent, or Firm* — George C. Rondeau, Jr.; Davis Wright Tremaine LLP

(57) ABSTRACT

A beverage container closure or lid that is adapted for closing an open end of a beverage container is provided. The lid is selectively couplable to the beverage container and includes a selectively openable cover that, when closed, creates a fluid-tight seal between the beverage container and the environment. The lid is provided with a dual-locking mechanism including an actuation disk locking mechanism and a press-button locking mechanism. Each locking mechanism is operable to transition between a locking position and an unlocking position and opening the cover to permit the passage of fluid requires that both locking mechanism be in their respective unlocking positions.

27 Claims, 25 Drawing Sheets

(51) Int. Cl.

| | |
|---|---|
| ***B65D 41/04*** | (2006.01) |
| ***B65D 43/02*** | (2006.01) |
| ***B65D 43/26*** | (2006.01) |
| ***B65D 55/02*** | (2006.01) |
| ***B65D 47/08*** | (2006.01) |
| ***B65D 47/32*** | (2006.01) |

(52) U.S. Cl.
CPC .... *B65D 2205/02* (2013.01); *B65D 2251/009* (2013.01); *B65D 2251/0015* (2013.01); *B65D 2251/0018* (2013.01); *B65D 2251/0028* (2013.01); *B65D 2251/0081* (2013.01); *B65D 2543/00046* (2013.01); *B65D 2543/0049* (2013.01); *B65D 2543/00092* (2013.01); *B65D 2543/00231* (2013.01); *B65D 2543/00546* (2013.01); *B65D 2543/00972* (2013.01)

(56) References Cited

U.S. PATENT DOCUMENTS

| | | | | |
|---|---|---|---|---|
| 8,056,745 | B2 | 11/2011 | Yu | |
| 8,596,493 | B2 * | 12/2013 | Vollers | B65D 47/0838 215/211 |
| 8,985,370 | B2 | 3/2015 | Lane | |
| 9,113,698 | B2 * | 8/2015 | Blain | A45F 3/18 |
| 2012/0145713 | A1 * | 6/2012 | Jung | A47J 41/0011 220/254.3 |
| 2012/0261416 | A1 * | 10/2012 | Lin | B65D 43/0229 220/253 |
| 2013/0119060 | A1 * | 5/2013 | Chiou | A47G 19/2272 220/254.3 |
| 2013/0319966 | A1 * | 12/2013 | Lane | B65D 43/26 215/237 |

* cited by examiner

LOCKABLE BEVERAGE CONTAINER CLOSURE

BACKGROUND

Field of the Invention

The present invention is directed generally to lids for liquid storage vessels such as for beverage or food containers and more particularly to lids with movable components and that include a plurality of locking mechanisms.

Description of the Related Art

Prior art lids are typically of one of three types. The first type is a solid unitary lid that does not include openings or apertures through which the contents of a liquid storage vessel may exit the vessel. To drink from the vessel, a user must remove the lid. The second type, which may also be of a unitary construction, includes one or more unobstructed apertures in the lid through which the liquid may exit the vessel. In the second type, the apertures are always open. If the vessel is inadvertently tipped or dropped, the contents of the vessel may spill. The third type of lid includes one or more apertures in the lid through which the liquid may exit the vessel and a means for selectively opening and closing the apertures. When using the third type of lid, the user may selectively open the apertures to remove the contents from the vessel and selectively close the apertures to maintain the contents inside the vessel. Further, by closing the apertures, the lid may help insulate the contents from the environment outside the vessel.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Embodiments of the present invention are directed to a lid or a closure for a beverage container that is adapted for closing an open end of the beverage container and isolating the contents of the beverage container from an outside environment. The lid is selectively couplable to the beverage container and is operable to permit the passage of fluid or another substance from the beverage container to an external environment (for example, to be drunk by a person).

Figure 1:
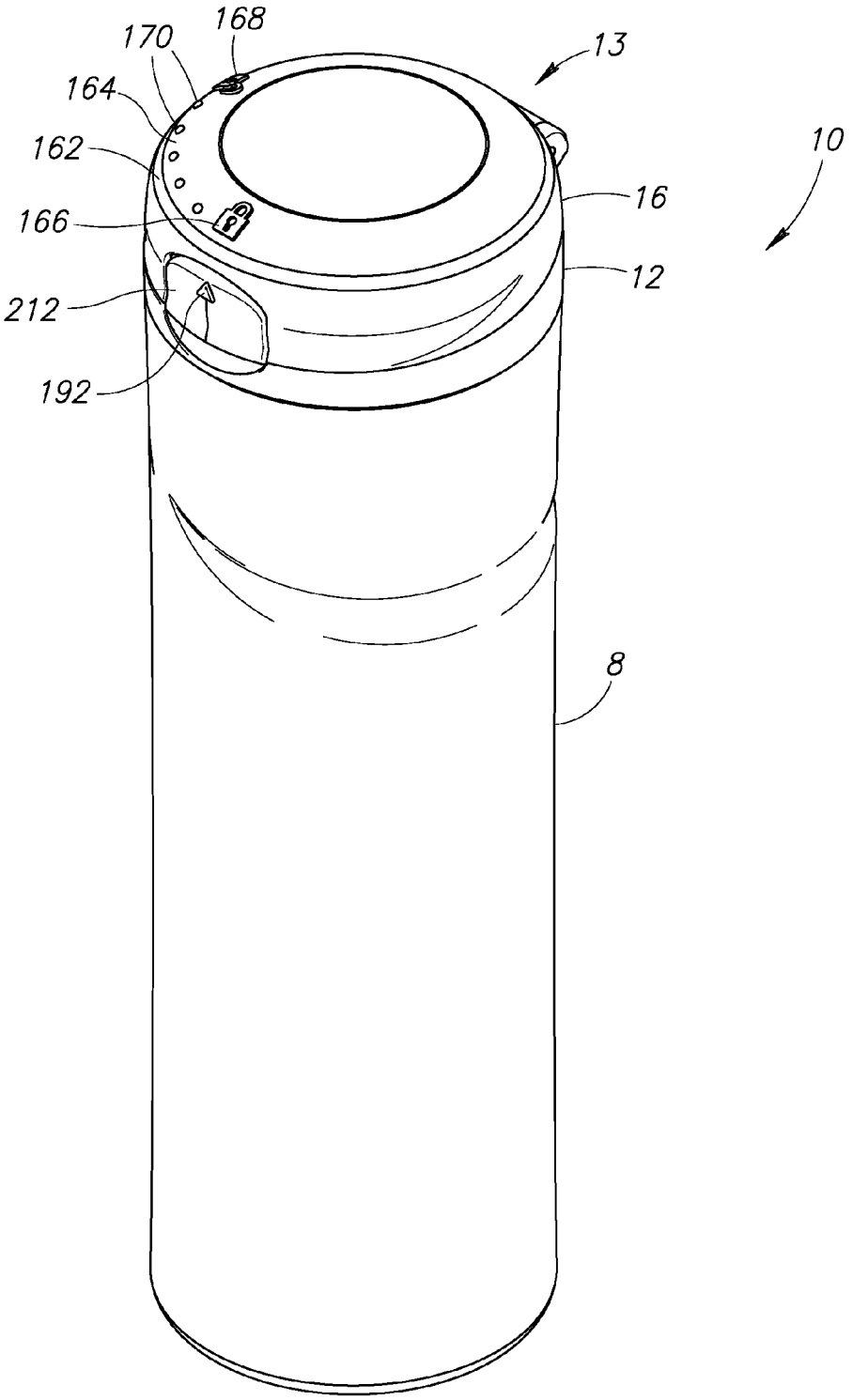
FIG. 1 illustrates a top left side perspective view of a lockable beverage container closure and beverage container according to an embodiment.
Figure 2:
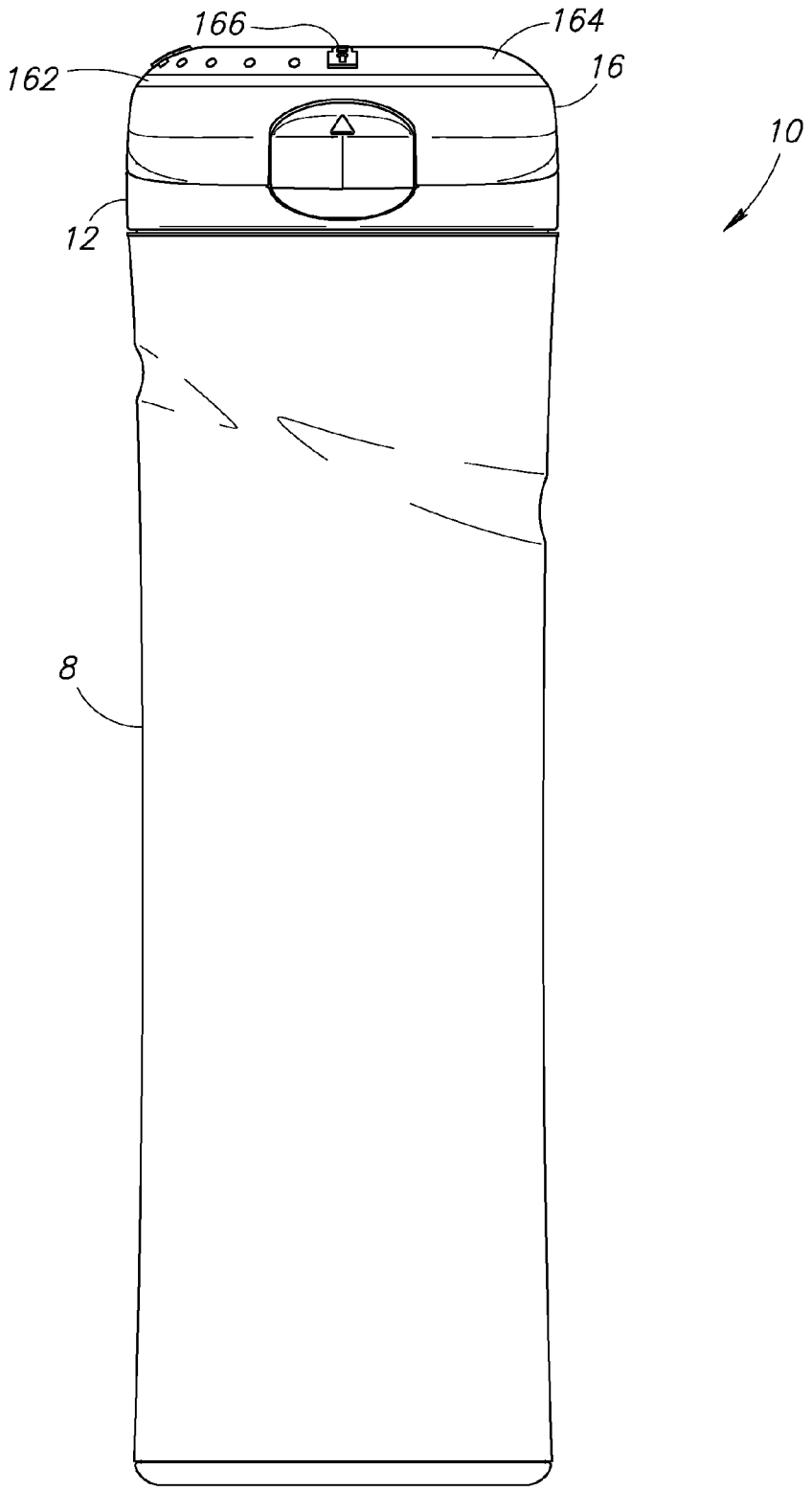
FIG. 2 illustrates a front elevational view of the lockable beverage container closure and beverage container.
Figure 3:
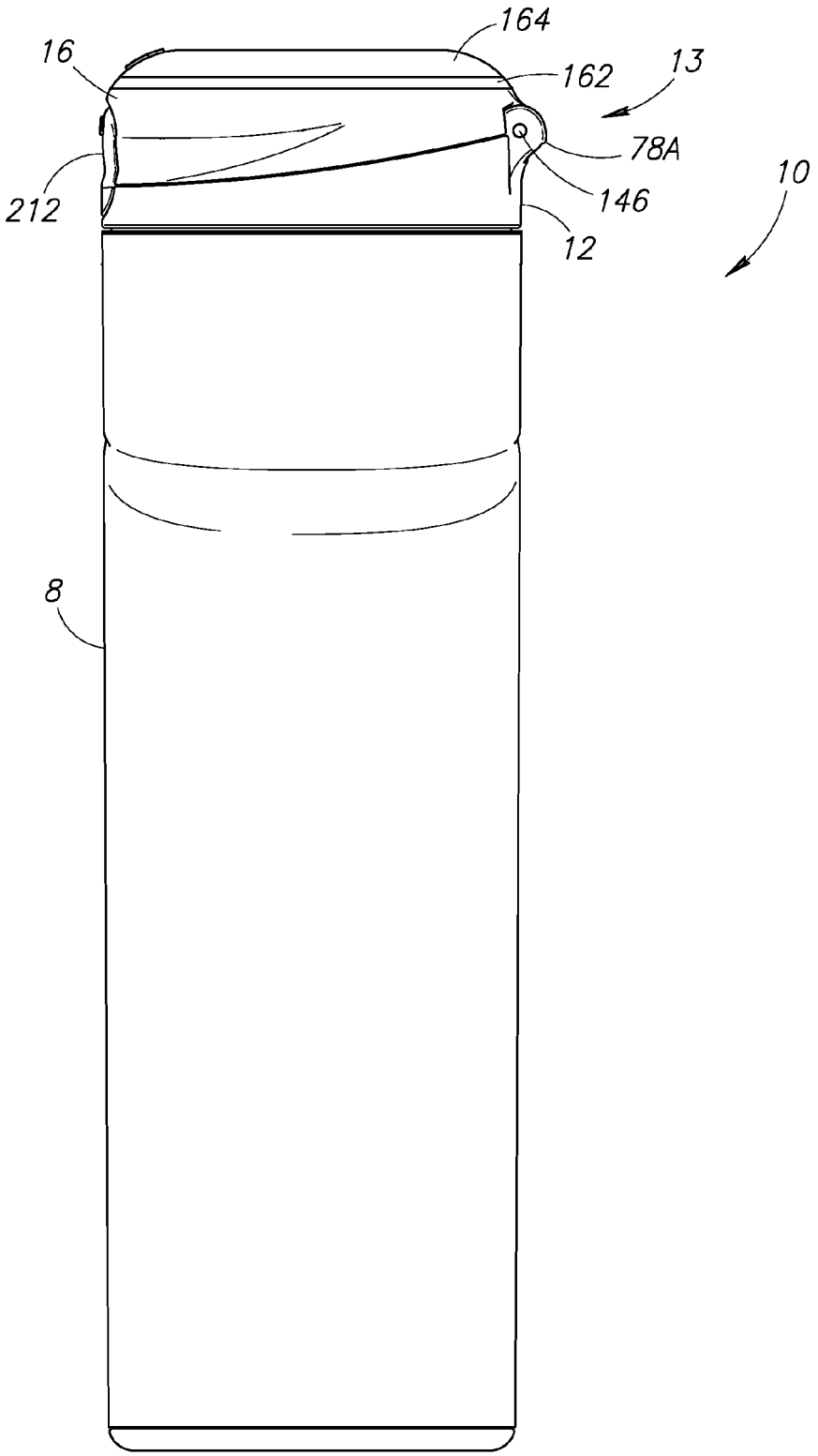
FIG. 3 illustrates a left side elevational view of the lockable beverage container closure and beverage container.
Figure 4:
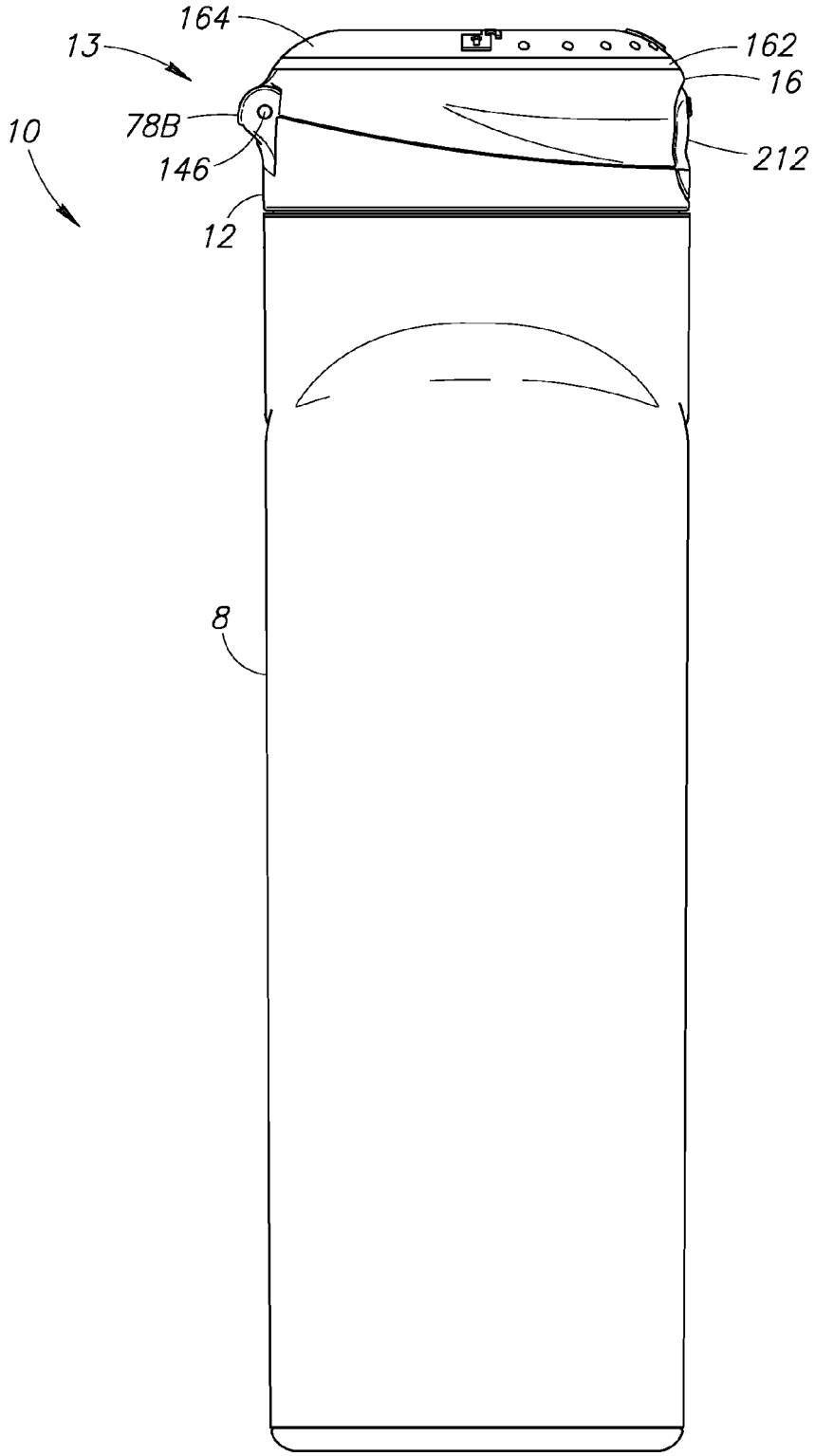
FIG. 4 illustrates a right side elevational view of the lockable beverage container closure and beverage container.
Figure 5:
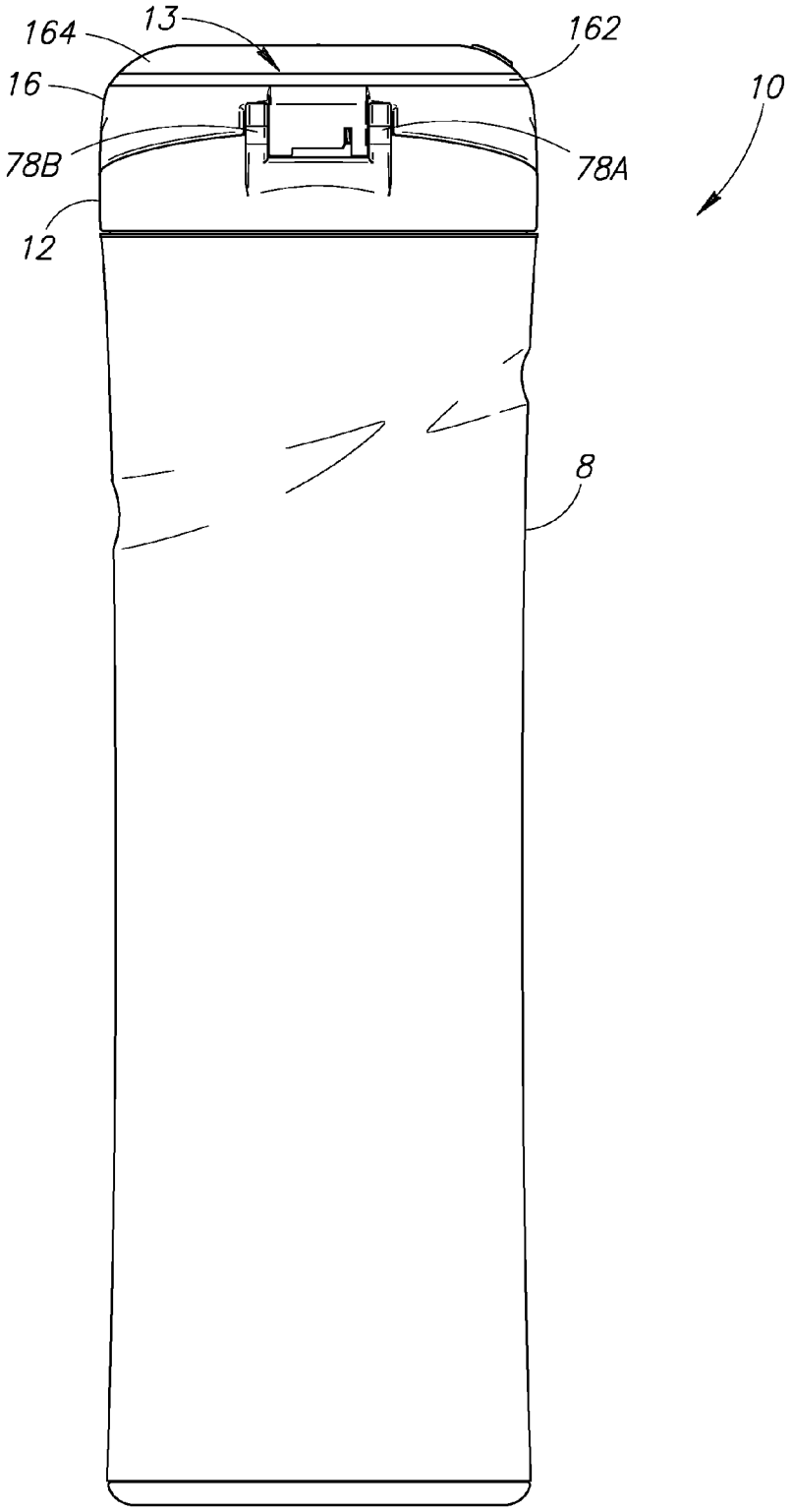
FIG. 5 illustrates a rear elevational view of the lockable beverage container closure and beverage container.
Figure 6:
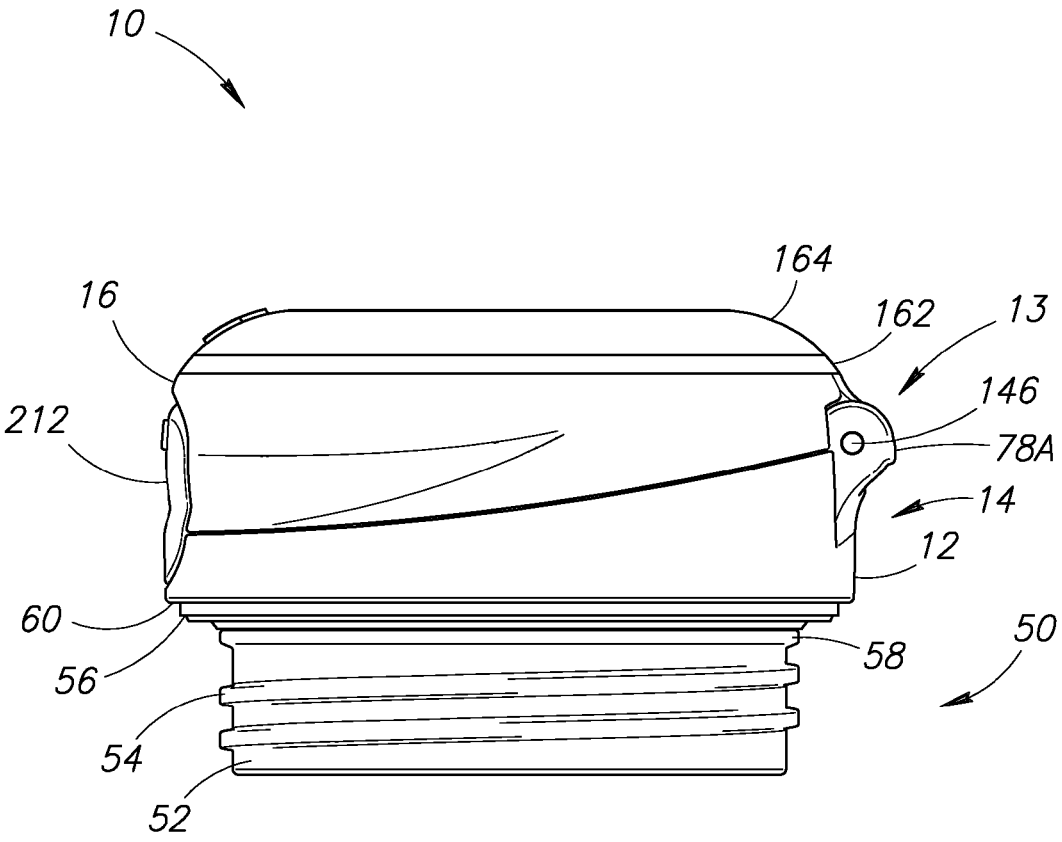
FIG. 6 illustrates a left side elevational view of the lockable beverage container closure without the beverage container.
Figure 7:
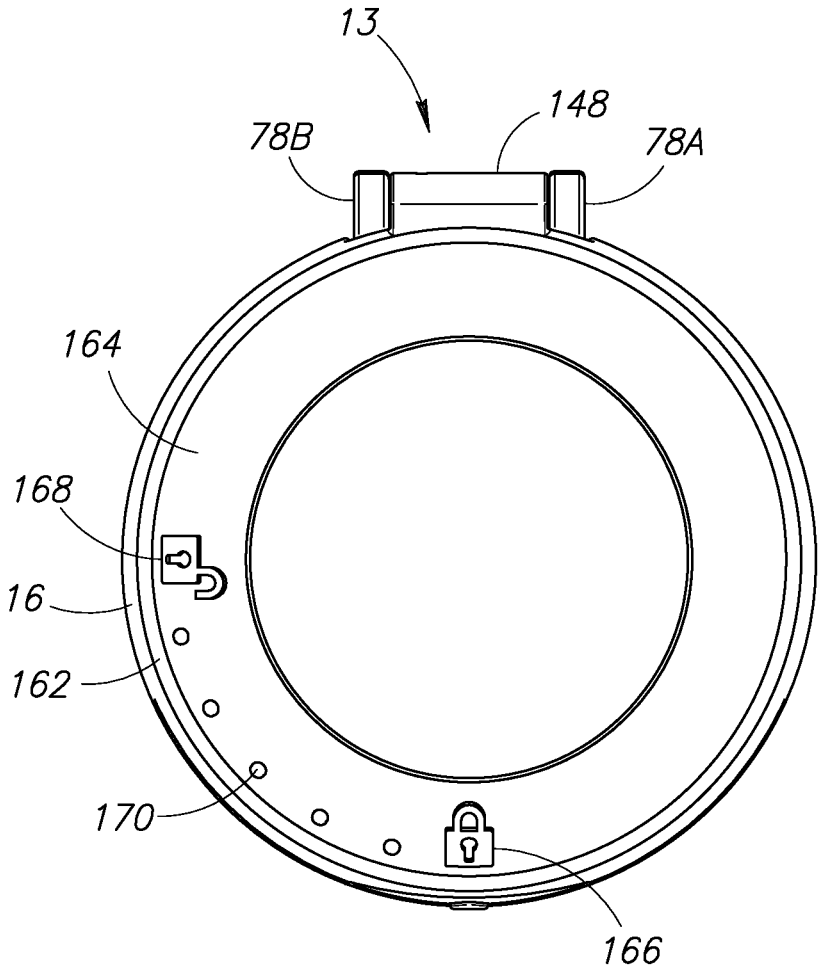
FIG. 7 illustrates a top plan view of the lockable beverage container closure.
Figure 8:
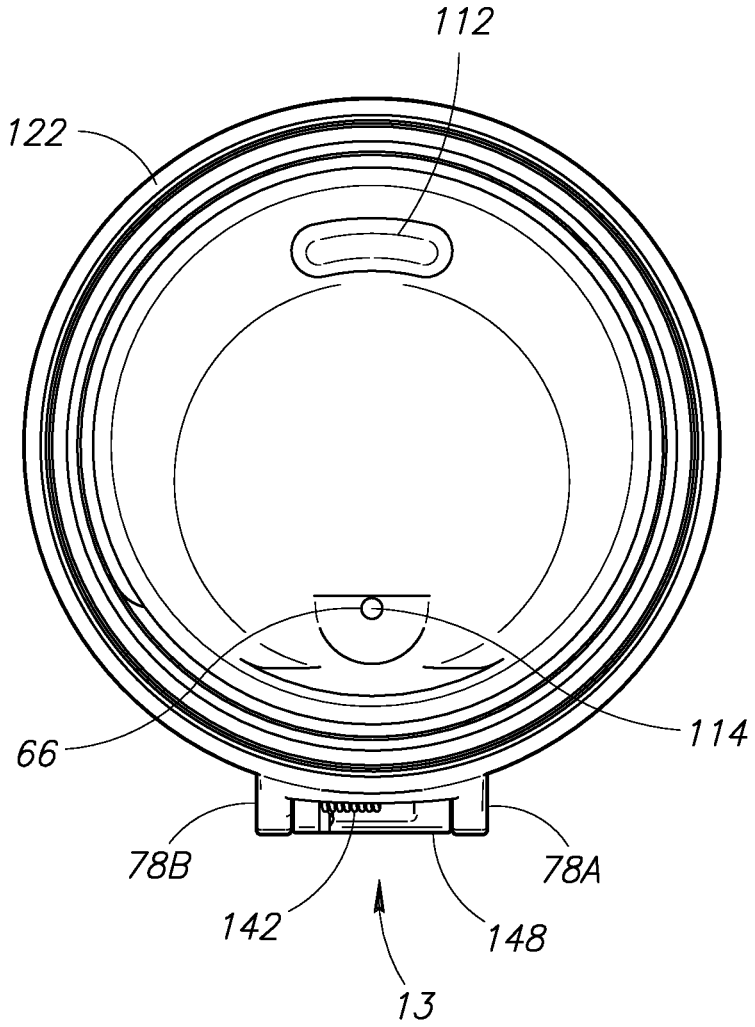
FIG. 8 illustrates a bottom plan view of the lockable beverage container closure.

A beverage container closure or lid, in accordance with an embodiment of the present invention, is generally indicated by reference numeral 10 in FIG. 1. The lid 10 has a generally cylindrical main body 12 that is adapted for closing an open end of a conventional drinking vessel or beverage container 8. The beverage container 8 may be any suitable type of container such as the tumbler type (that is, without a handle) for use in automotive beverage receptacles, or for transport in backpacks, book bags, and the like. As shown in FIG. 6, the lid 10 is selectively couplable to the beverage container 8 by any suitable means such as threads 54 disposed on an outer surface of a sidewall 52 of a lower, downwardly depending portion 50 of the main body 12. The lid 10 also includes a flexible O-ring seal member 56 positioned adjacent the sidewall 52 of the lower portion 50 at a location near a bottom surface 60 of an upper portion 14 of the main body 12. Also disposed on the outer surface of the sidewall 52 is a retaining thread 58 for the seal member 56. The retaining thread 58 is operable to secure the positioning of the seal member 56 adjacent to the bottom surface 60 of the upper portion 14 of the main body 12. The particular configuration for mating the lid 10 to the container 8 is a matter of choice for one of ordinary skill in the art. Thus, although threads 54 and the seal member 56 have been shown in this embodiment, those of ordinary skill in the art will appreciate that any other means for attaching and sealing the lid 10 with respect to the beverage container 8 may be substituted.

Figure 12:
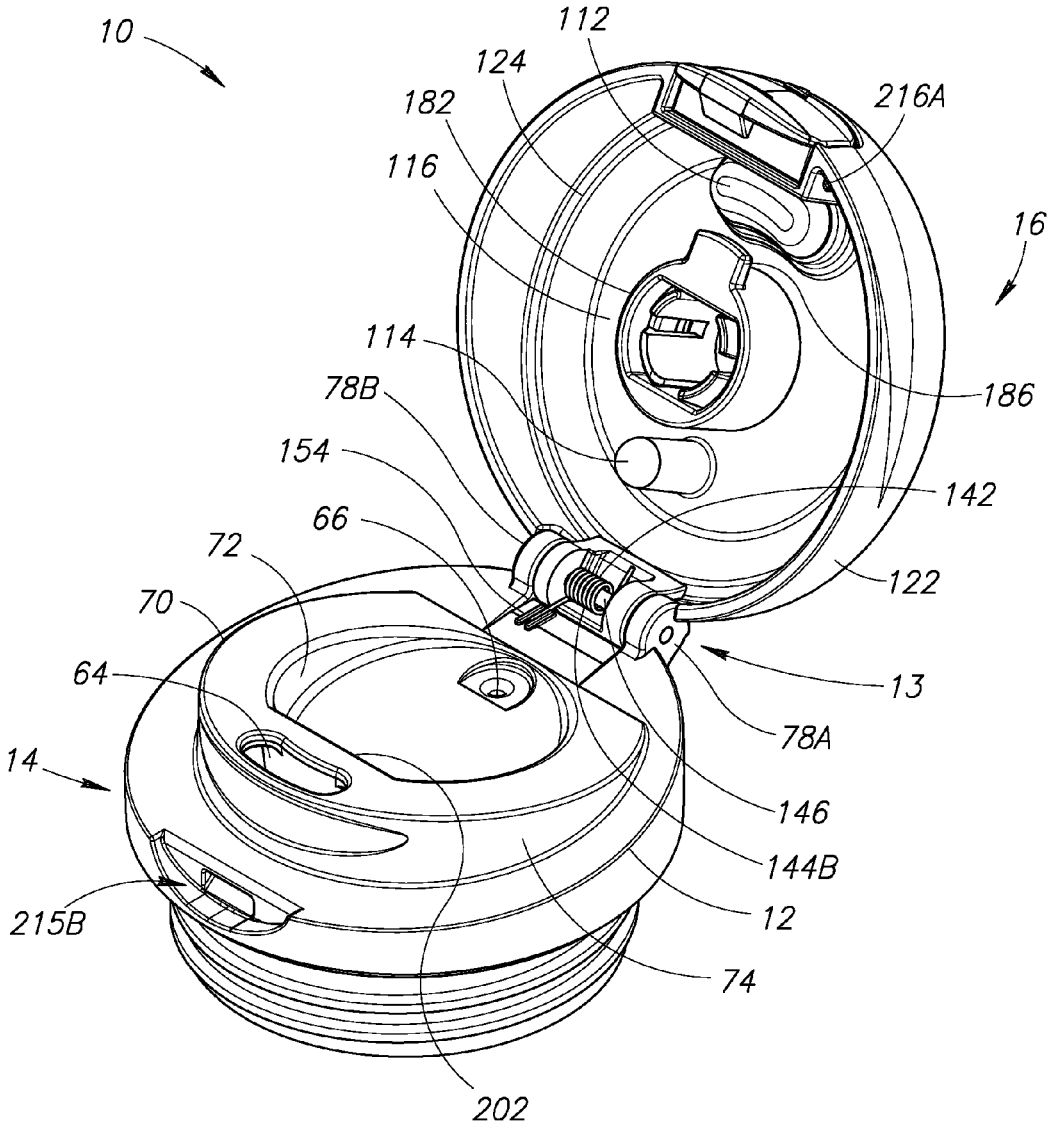
FIG. 12 illustrates an enlarged top left side perspective view of the lockable beverage container closure in the open position.

As best seen in FIG. 12, the upper portion 14 of the main body 12 also includes a drinking spout 70 configured for contact with a user's lips when the entire assembly comprising the beverage container 8 and the lid 10 is tipped toward the user with the lid 10 open, such that the user may drink from the beverage container 8 to which the lid 10 is attached. The drinking spout 70 is configured with an aperture or drinking opening 64 configured to permit fluid passage therethrough when a user drinks a beverage. The upper portion 14 of the main body 12 of the lid 10 also includes a vent hole 66 that serves as an air breather hole to allow air to flow into the beverage container 8 when fluid is passing out of the drinking spout 70. The annular-shaped inner wall portion 72 of the drinking spout 70 operates to contain any liquid released through the vent hole 66.

Figure 11:
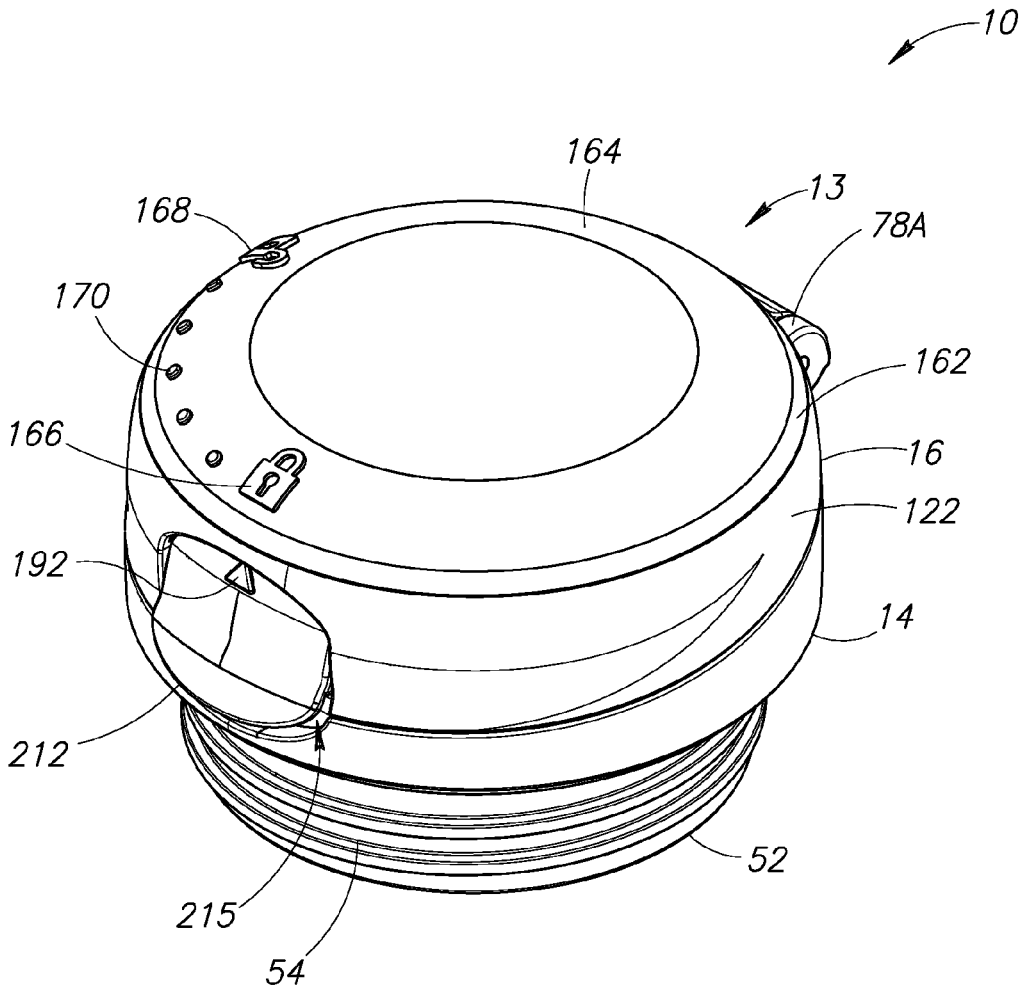
FIG. 11 illustrates an enlarged top left side perspective view of the lockable beverage container closure in the closed position.
Figure 18:
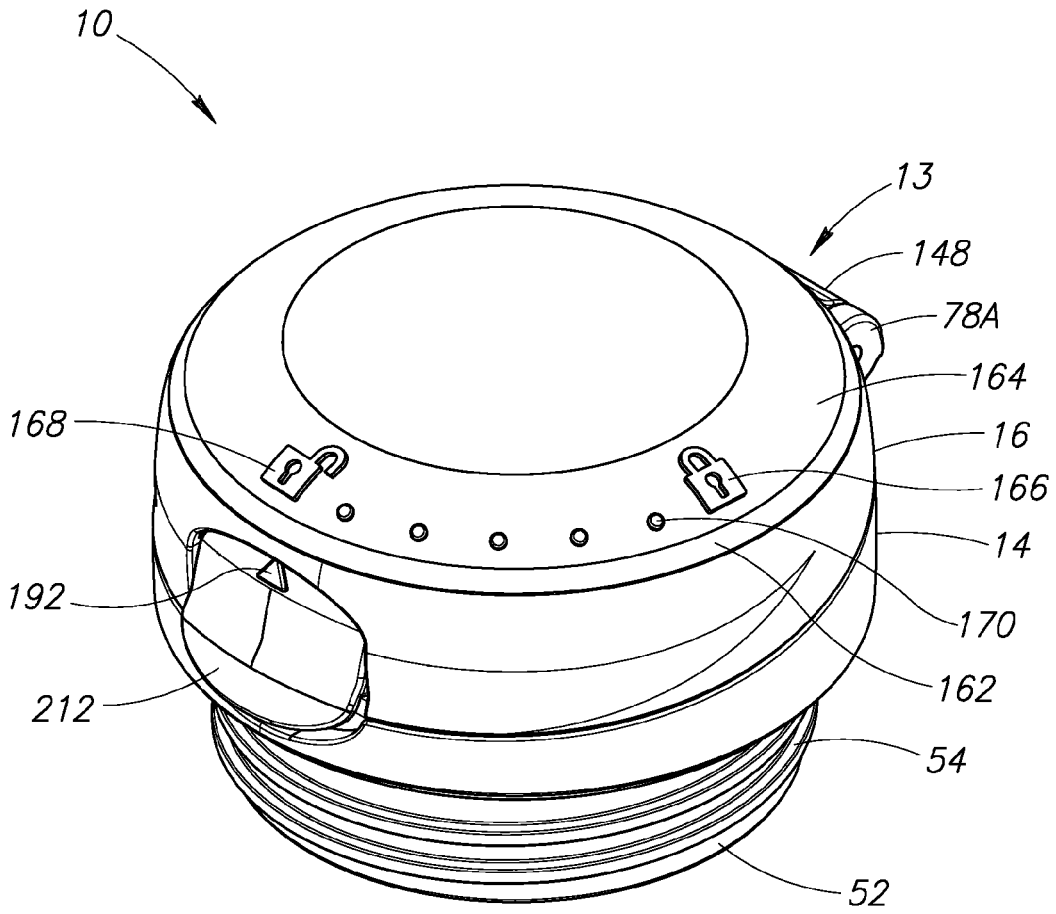
FIG. 18 illustrates an enlarged top left side perspective view of the lockable beverage container closure with a second locking mechanism of the lockable beverage container closure actuated to the unlocking position.
Figure 19:
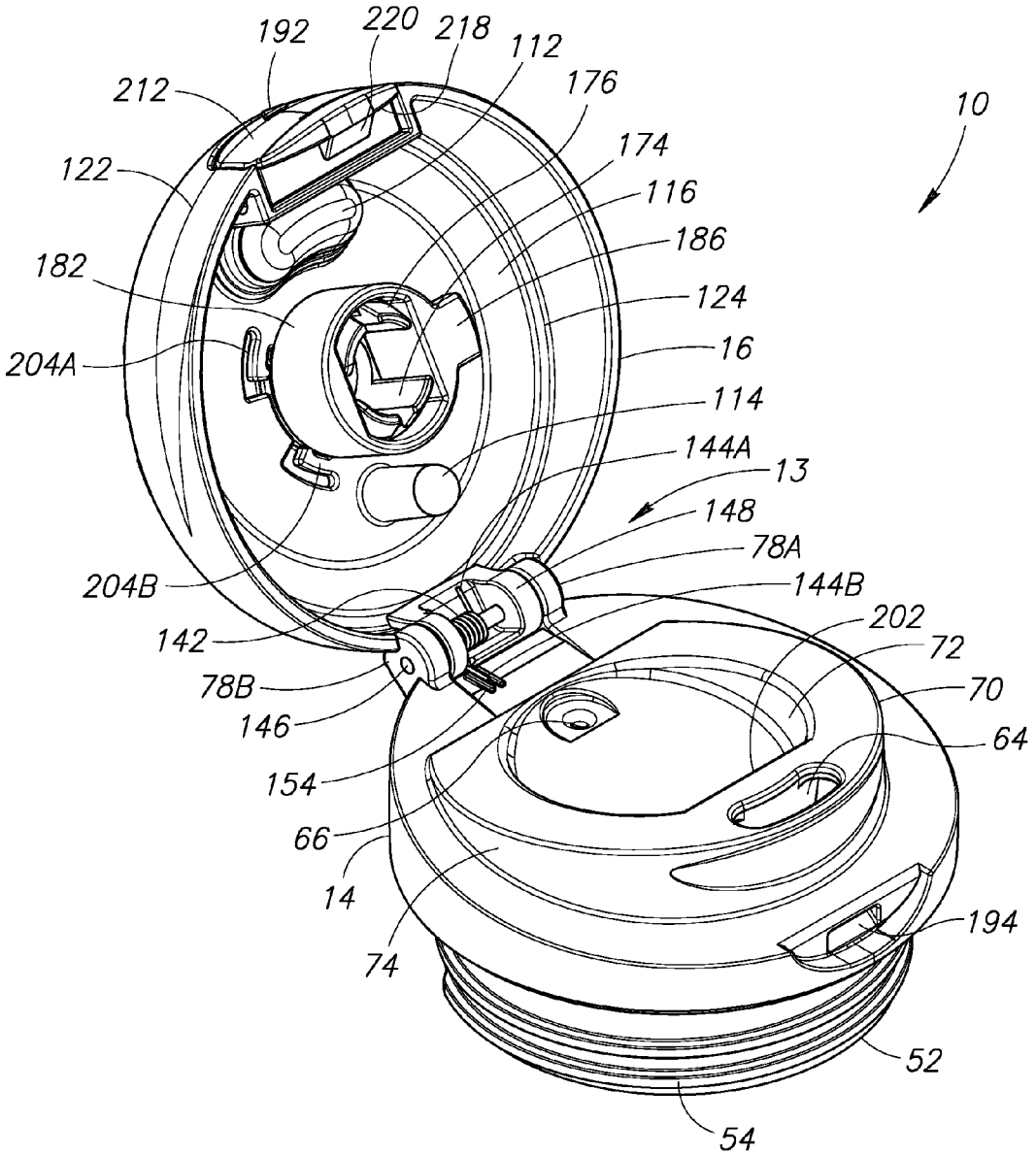
FIG. 19 illustrates an enlarged top right side perspective view of the lockable beverage container closure in the open position.
Figure 20:
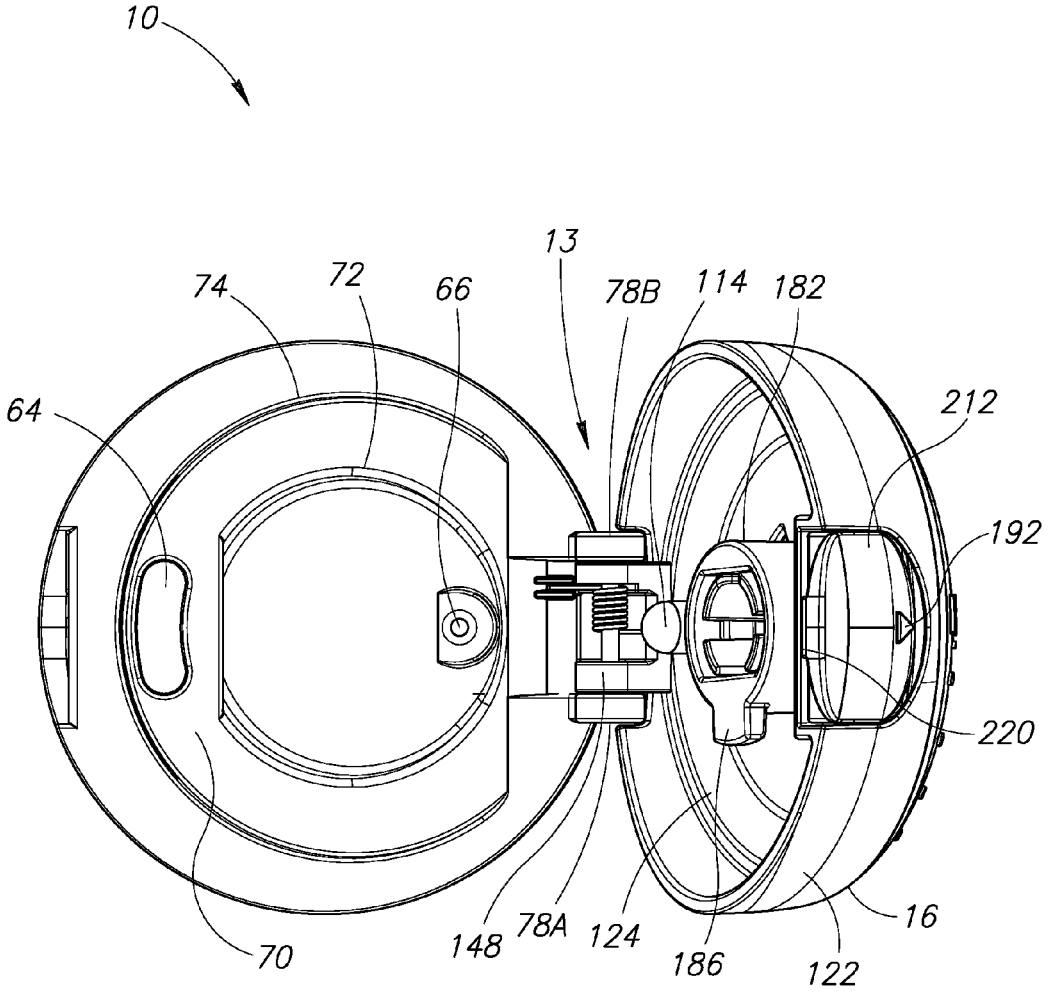
FIG. 20 illustrates a top plan view of the lockable beverage container closure in the open position.
Figure 21:
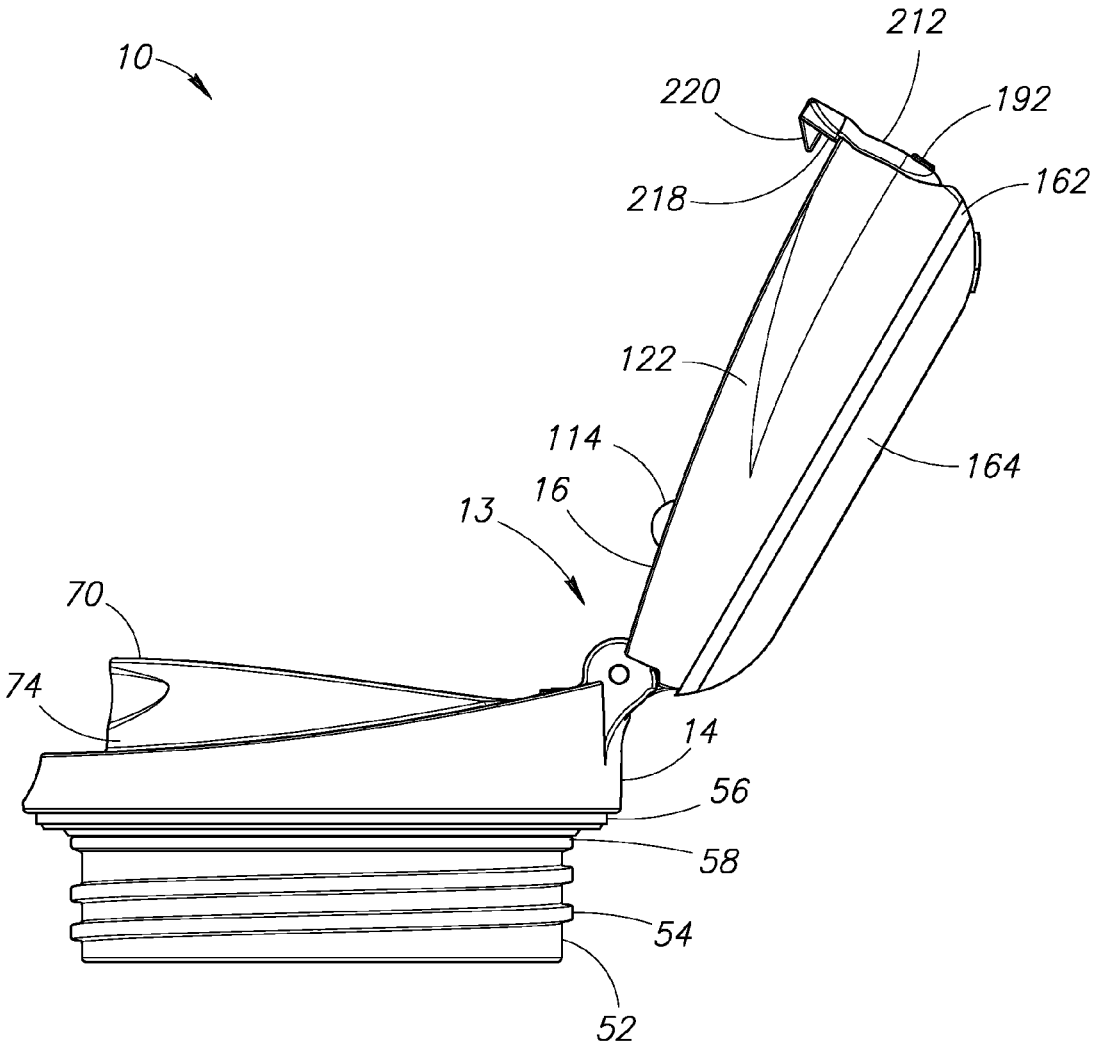
FIG. 21 illustrates a left side elevational view of the lockable beverage container closure in the open position.
Figure 22:
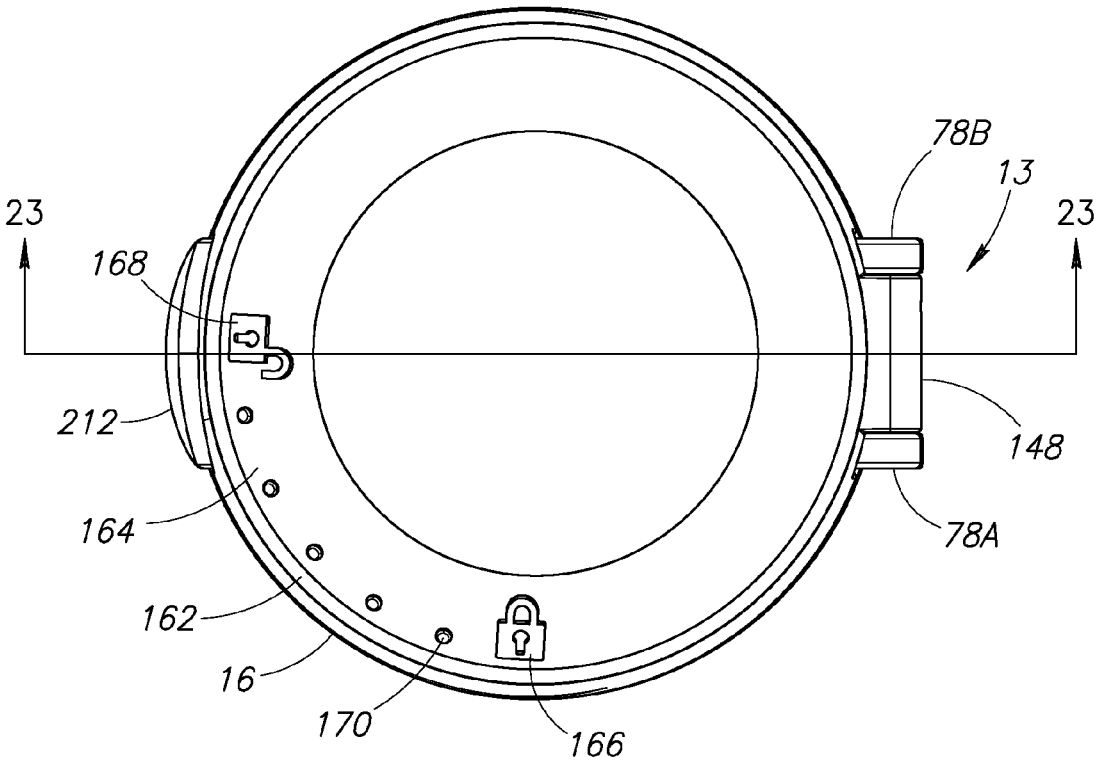
FIG. 22 illustrates a top plan view of the lockable beverage container closure with the first locking mechanism and the second locking mechanism of the lockable beverage container closure in the unlocking positions.

Coupled to the upper portion 14 of the main body 12 of the lid 10 is a lid cover 16. The lid cover 16 is operable to transition between a closed position (as shown in FIGS. 11 and 18) and an open position (as shown in FIGS. 12, 13 and 19-21). The lid cover 16 has a substantially circular surface and a substantially circumferential downwardly extending exterior wall 122. The exterior wall 122 is operative to enclose the drinking spout 70 and vent hole 66 of the main body 12 of the lid 10 when the lid cover is in the closed position. Also extending downwardly from the lid cover 16 is an interior wall 124. The interior wall 124 may have a plurality of portions and may be operative to abut an exterior wall 74 of the drinking spout when the lid cover 16 is in the closed position so as reduce lateral movement of the lid cover 16 with respect to a vertical axis of the main body 12 of the lid 10.

Figure 10:
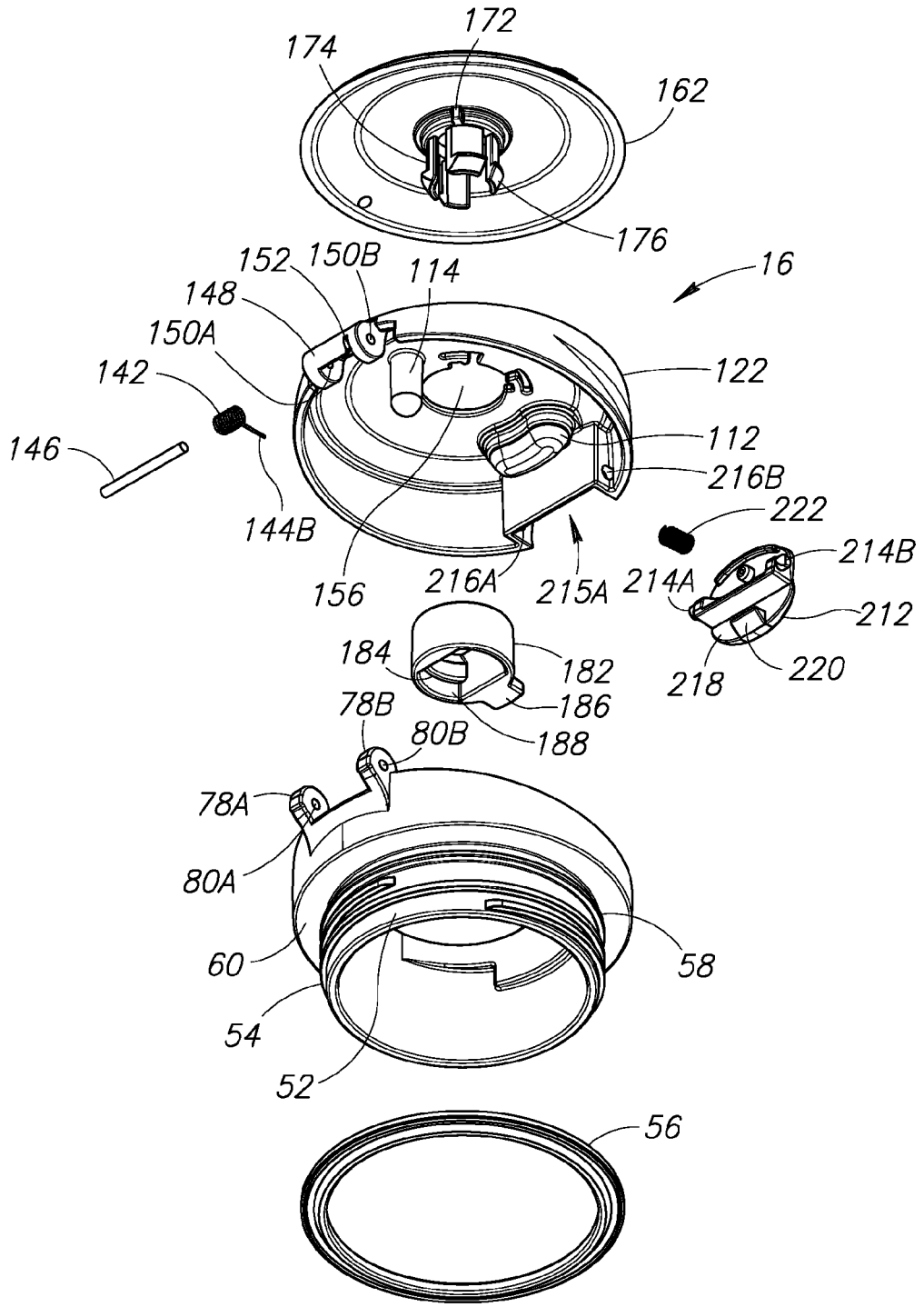
FIG. 10 illustrates an exploded bottom right side perspective view of the lockable beverage container closure.

The lid cover 16 is coupled to the main body 12 using a hinge mechanism 13 that permits the rotation of the lid cover 16 about a transverse rotary axis of the hinge. To enable the hinge mechanism 13, the main body 12 is configured with a pair of spaced apart arms 78A, 78B, whereby each arm has a respective aperture 80A, 80B extending therethrough, as shown in FIG. 10. The apertures 80A, 80B are adapted for receiving a hinge pin 146, whereby the apertures 80A, 80B permit initial passage of the hinge pin 146 (when the hinge mechanism is assembled) and subsequently hold the hinge pin 146 to enable rotatably coupling the lid cover 16 and the main body 12.

As shown in FIG. 10, the lid cover 16 includes an inner arm portion 148 having inner arm portion apertures 150A, 150B. The inner arm portion 148 is configured with a pocket for receiving a torsion spring 142 having two radially extending ends 144A, 144B. The torsion spring 142 is formed by a series of helically wound coils defining an open interior. When assembled, the torsion spring is fitted in the pocket of the inner arm portion 148, and the inner arm portion 148 is inserted between the spaced apart arms 78A, 78B of the main body 12 so that the arm apertures 80A, 80B, the inner arm portion apertures 150A, 150B and the open interior of the torsion spring 142 are axially aligned. Further, the inner arm portion 148 is configured with a first holding slot 152 for receiving the first extending end 144A of the torsion spring 142 and the main body 12 is configured with a second holding slot 154 for receiving the second extending end 144B of the torsion spring 142, as best seen in FIG. 12. The hinge pin 146 is fitted into the arm apertures 80A, 80B, the inner arm portion apertures 150A, 150B and the open interior of the torsion spring 142, thereby relatively rotatably connecting together the lid cover 16 and the main body 12.

Figure 15:
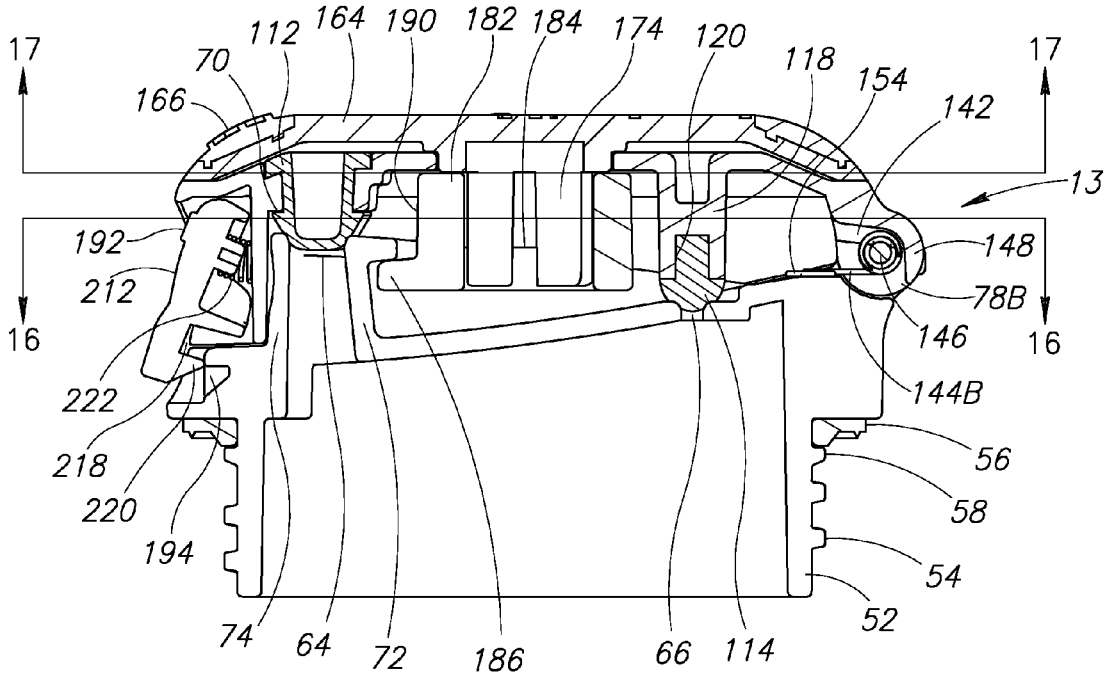
FIG. 15 illustrates a cross-sectional view of the lockable beverage container closure taken substantially through line 15-15 of FIG. 14 with a first locking mechanism of the lockable beverage container closure in the locking position.
Figure 16:
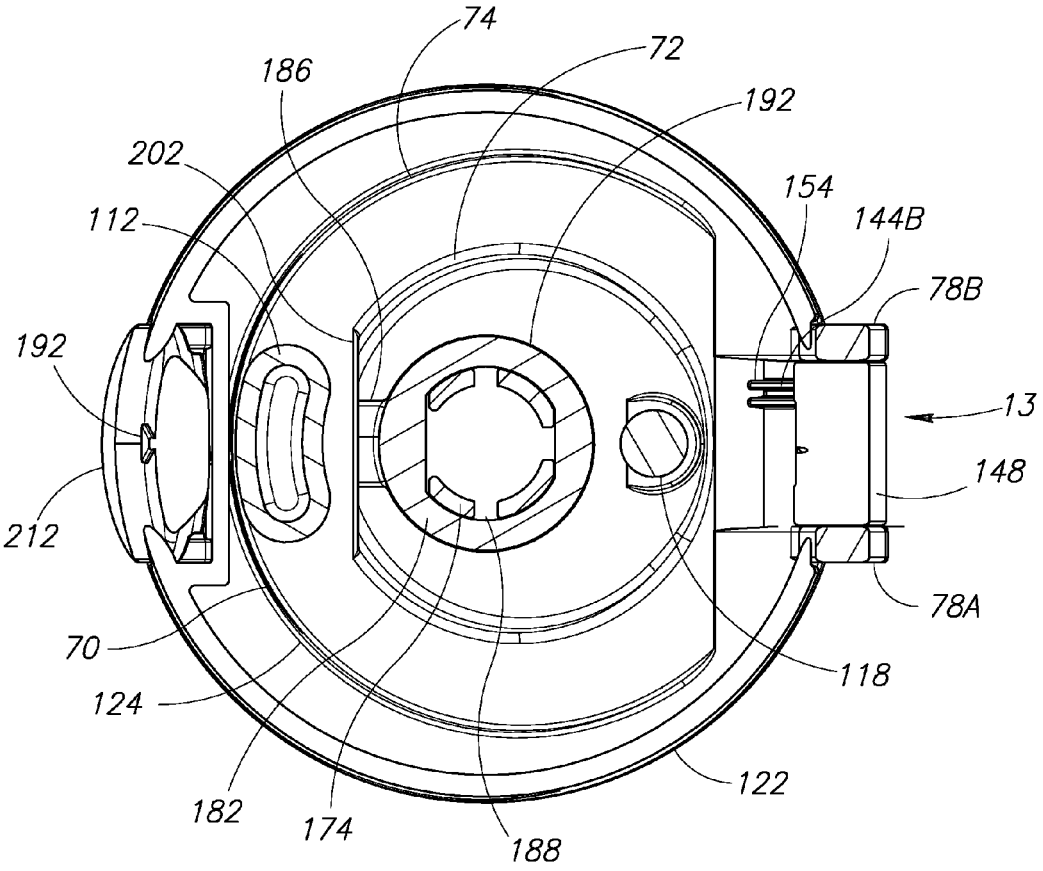
FIG. 16 illustrates a cross-sectional view of the lockable beverage container closure taken substantially through line 16-16 of FIG. 15.
Figure 23:
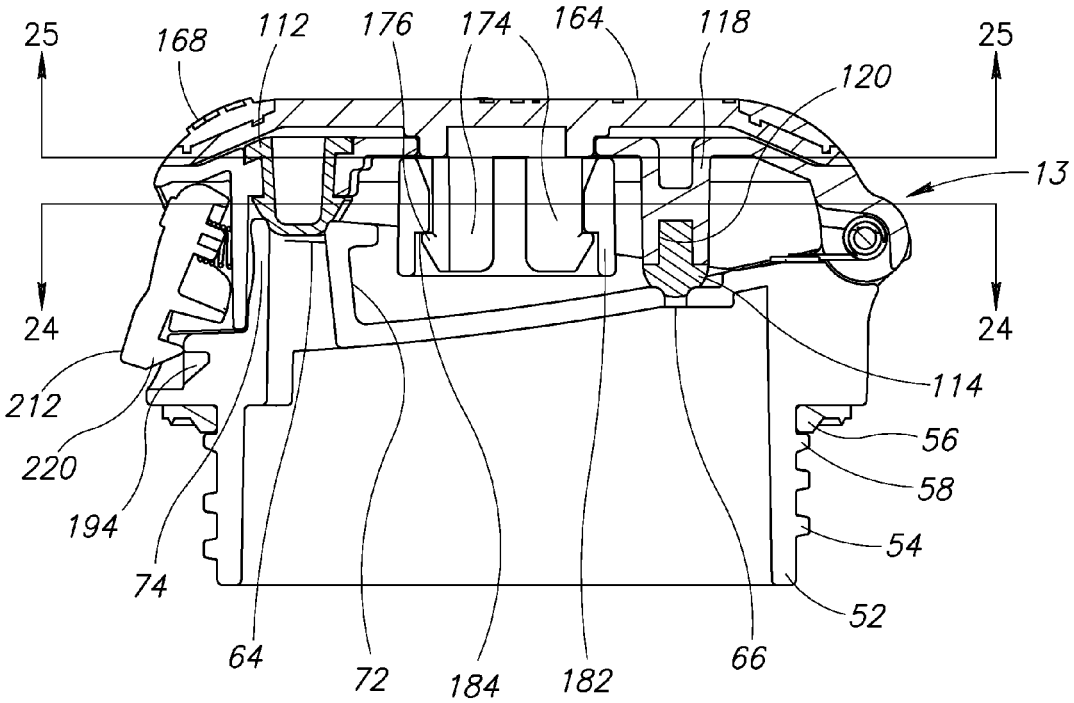
FIG. 23 illustrates a cross-sectional view of the lockable beverage container closure taken substantially through line 23-23 of FIG. 22.
Figure 24:
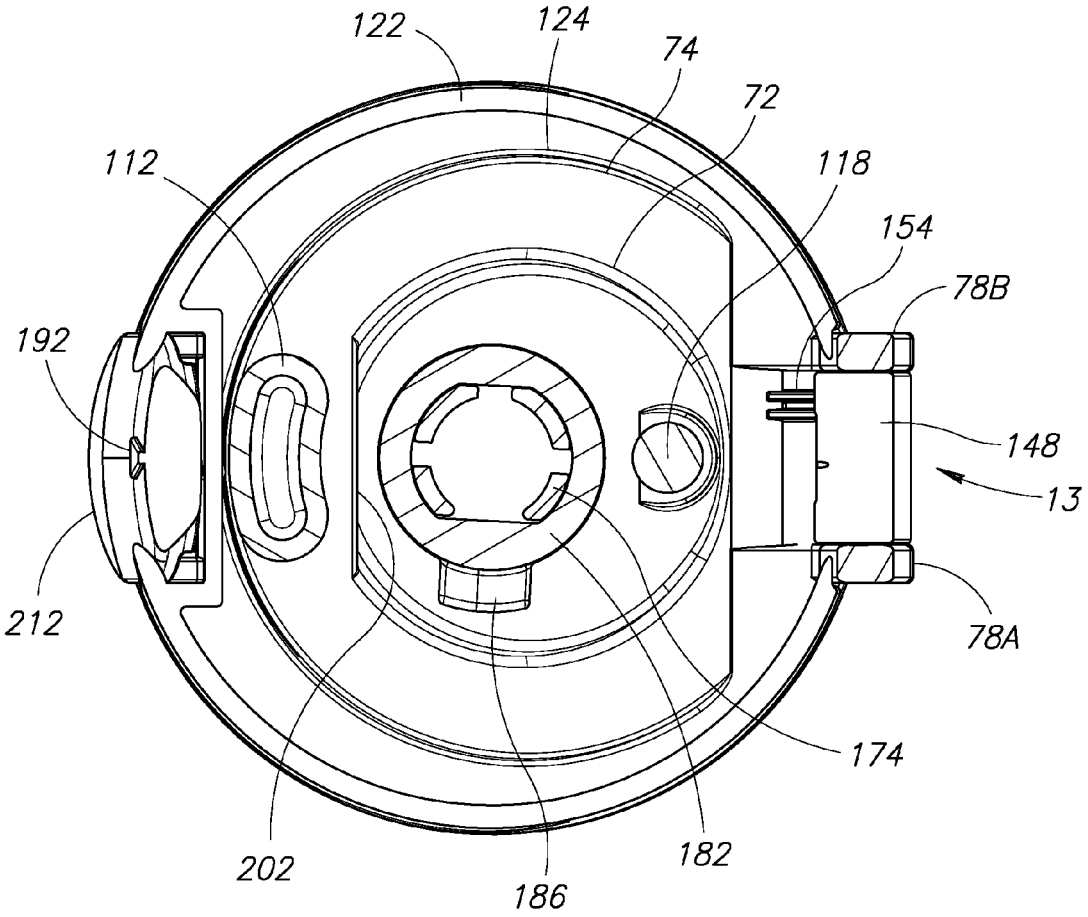
FIG. 24 illustrates a cross-sectional view of the lockable beverage container closure taken substantially through line 24-24 of FIG. 23.

As shown in FIG. 12, disposed on an interior surface 116 of the lid cover 16 is a drinking opening plug 112 and a vent hole plug 114. The drinking opening plug 112 may be formed from a flexible material and is contoured so as to fit the drinking opening 64. When pressed against the drinking opening 64 in the closed position, the drinking opening plug 112 operates to seal the drinking opening 64 and thereby prevent the passage of fluid or other substance through the drinking opening 64. The vent hole plug 114 may also be formed from a flexible material and operates to seal the vent hole 66 when the lid 10 is in the closed position. As is recognized, the positioning of the drinking opening plug 112 and a vent hole plug 114 in relation to the interior surface 116 of the lid cover 16 corresponds to the respective placement of the drinking opening 64 and the vent hole 66 in the main body 12 of the lid 10 such that when the lid 10 is closed due to an engagement of the cover 16 and the main body 16 as described herein, passage of liquid or another substance through the drinking opening 64 or the vent hole 66 is prevented. Further, as may be best viewed in FIGS. 15 and 23, a support portion 118 is used to position the vent hole plug 114 away from the interior surface 116 of the lid cover 16 so that it can reach of the vent hole plug 114. A recess 120 in the support portion 118 is adapted for receiving and holding a portion of the vent hole plug 114 therein.

Locking Mechanisms

The lid 10 has a dual-locking mechanism comprising an actuated disk lock and a press-button lock. Passage of fluid or another substance through the drinking opening 64 may only be permitted if both locking mechanisms of the lid 10 are actuated to be in an unlocking position. If at least one of the locking mechanisms of the lid 10 is in the locking position, the lid 10 is configured such that the drinking opening plug 112 seals the drinking opening 64 and a fluid or another substance is prevented from passing through the drinking opening 64. Similarly, the vent hole plug 114 prevents fluid or another substance from passing through the vent hole 66. The dual-locking mechanism is advantageous in that if one locking mechanism is accidentally actuated, the second locking may serve as a safety and prevent the lid 10 from being placed in an open position.

Figure 9:
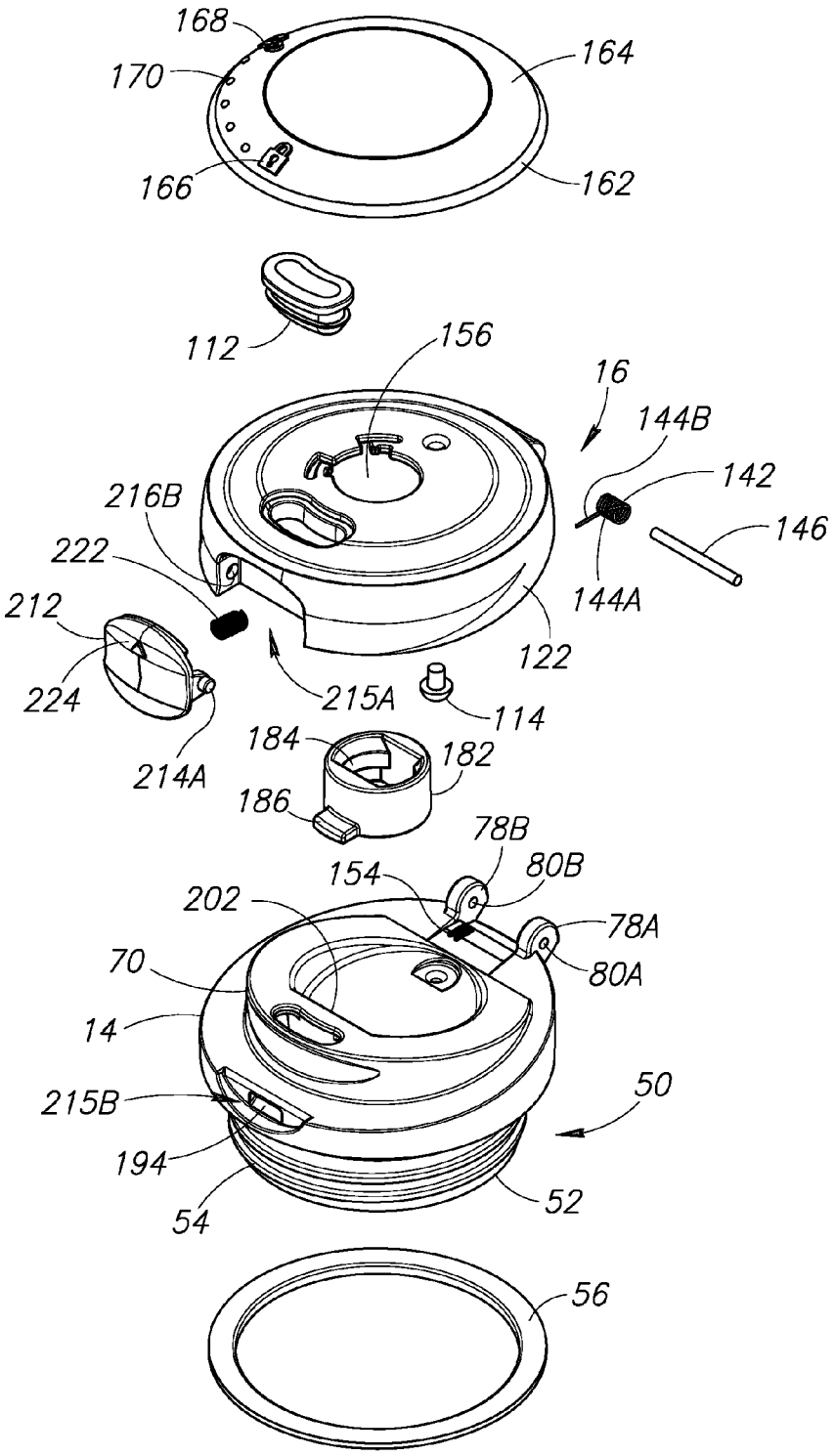
FIG. 9 illustrates an exploded top left side perspective view of the lockable beverage container closure.

A first locking mechanism includes, disposed on an exterior surface of the lid cover 16, a manually rotatable actuation disk 162 having a top grip surface 164. As shown in FIG. 10, extending downwardly from a bottom surface of the actuation disk 162 are four legs 174 (also singularly referred to herein by the same numeral) configured to pass through an aperture 156 of the lid cover 16. The legs 174 are also configured to pass through a locking ring 182 disposed adjacent to an interior surface of the lid cover 16. The downwardly extending legs 174 are further configured with a slanted finger portion 176 operative to reach around and snap-fit about a shoulder 184 disposed on an interior surface 188 of the locking ring 182. The locking ring 182 is shown in FIGS. 9 and 10 as a hollowed cylindrical walled member having the shoulder 184 disposed on its interior surface 188. Disposed on an exterior surface 190 of the locking ring 182 is an outwardly projecting tab 186. When the actuation disk 162 and the locking ring 182 are assembled, the outwardly projecting tab 186 is rotatably coupled to the top cover 162 such that rotation of the actuation disk 162 results in circular movement of the tab 186, whereby the actuation disk 162 may be rotatable in plane that is transverse to a longitudinal axis of the drink arrangement.

Figure 13:
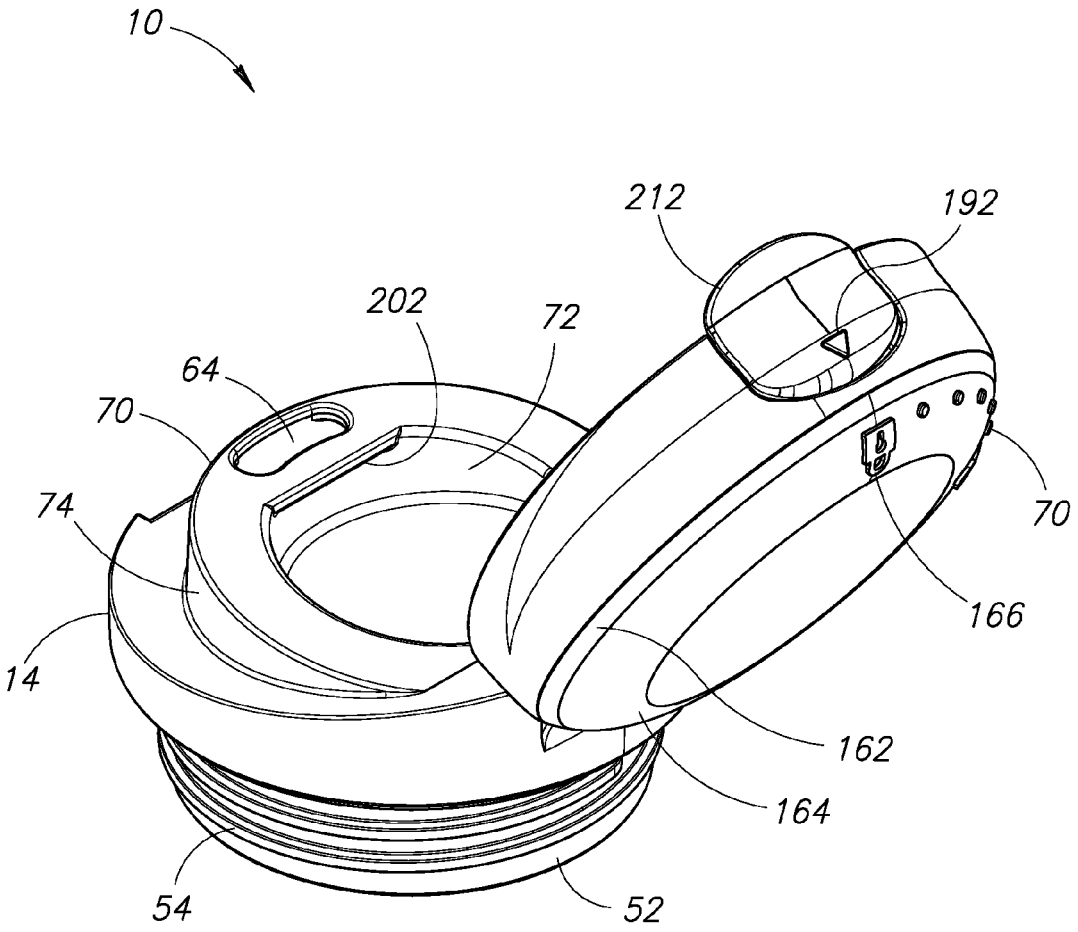
FIG. 13 illustrates an enlarged top left side perspective view of the lockable beverage container closure in the open position.
Figure 14:
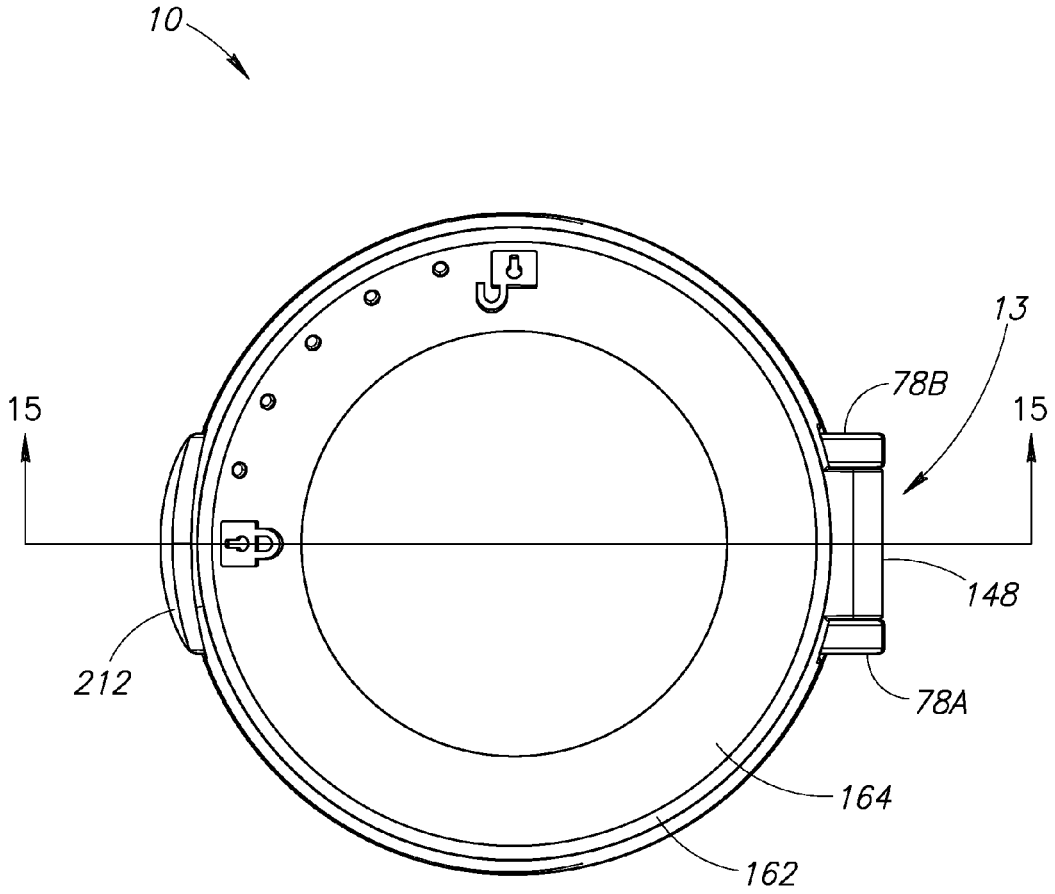
FIG. 14 illustrates a top plan view of the lockable beverage container closure.

As shown in FIG. 13, provided in an inner wall portion 72 of the drinking spout 70 of the main body 12 of the lid 10 is a ledge 202 for positioning of the tab 186 thereunder when the tab 186 is positioned adjacent to the ledge 202. When the tab 186 is caught by the ledge 202, the lid cover 16 cannot be rotated upward about the hinge mechanism 13 and thereby is secured in the closed position. Further circular motion of the tab 186 in a direction away from the ledge 202 (as a result of rotary actuation of the actuation disk 162) frees the tab 186 from the ledge 202 and enables rotation of the lid cover 16 upward about the hinge mechanism 13 and away from the main body 12 of the lid 10.

The top grip surface 164 of the actuation disk 162 has disposed thereon lock indicia 166, unlock indicia 168 and nubs 170. The nubs 170 are provided to facilitate manual gripping of the grip surface 164 and hence rotation of the actuation disk 162. The lock indicia 166 and unlock indicia 168 are provided to indicate to a user whether the first locking mechanism using the tab 186 enabled by the actuation disk 162 is in the locking position or in the unlocking position. An alignment mark 192 disposed on the lid 10 serves as a position reference to the lock indicia 166 and the unlock indicia 168.

Figure 17:
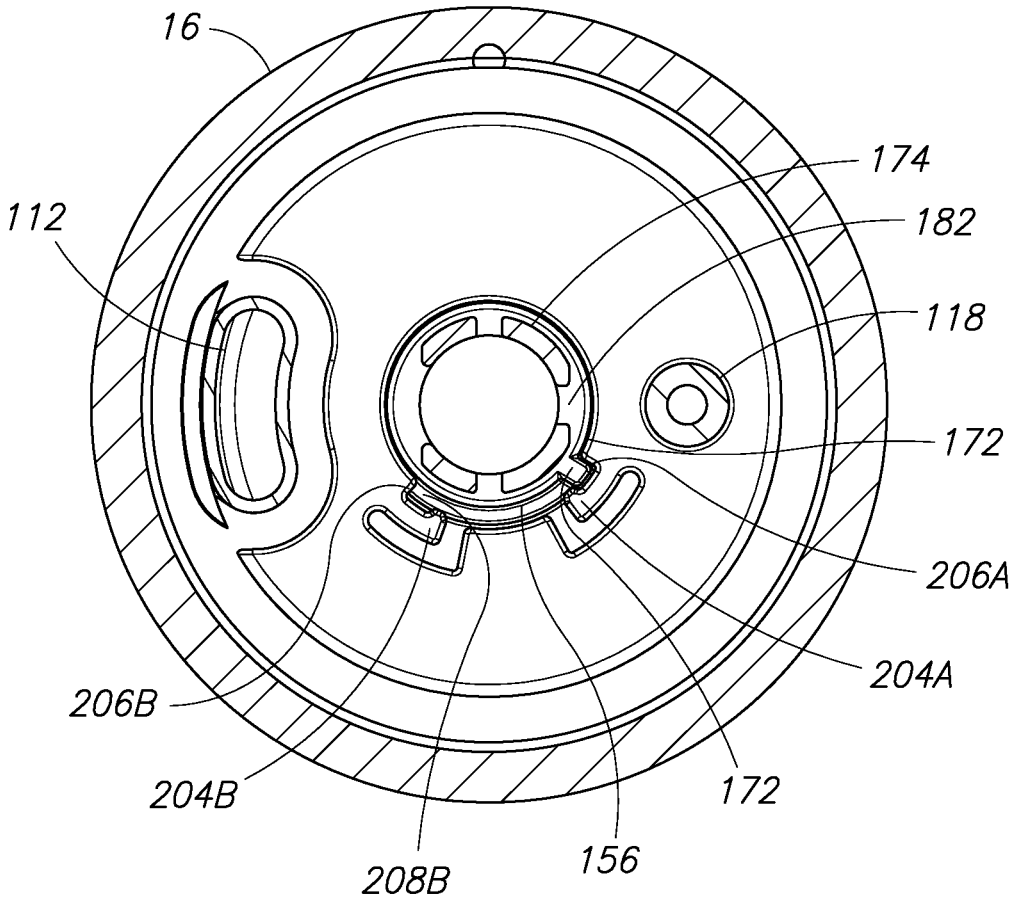
FIG. 17 illustrates a cross-sectional view of the lockable beverage container closure taken substantially through line 17-17 of FIG. 15.
Figure 25:
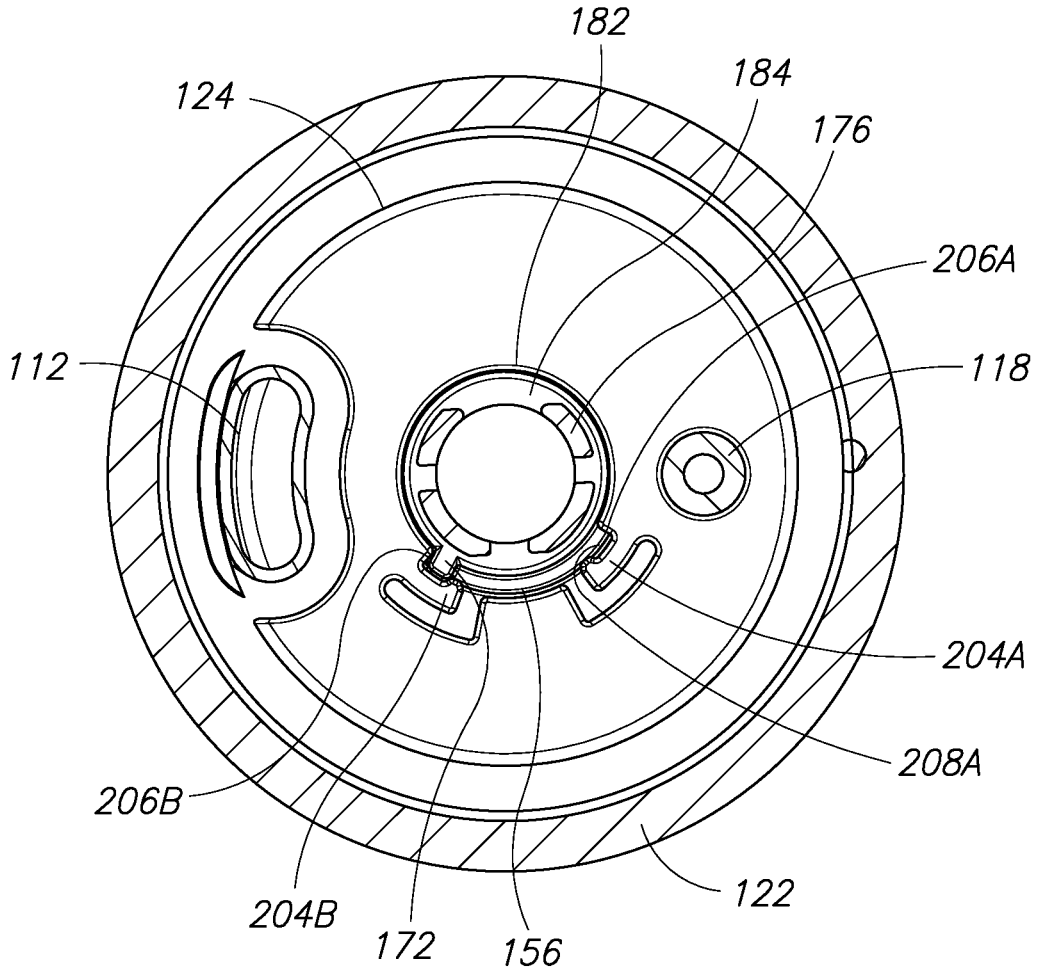
FIG. 25 illustrates a cross-sectional view of the lockable beverage container closure taken substantially through line 25-25 of FIG. 23.

A tab 172 shown in FIG. 10 is disposed on the bottom or interior surface of the actuation disk 162 and rotates with the actuation disk. The tab 172 is configured such that the rotation of the actuation disk 162 and tab 172 assembly is restricted to an arc between the locking and unlocking positions. The aperture 156 of the lid cover 16 is contoured such that the tab 172 is used to restrict the rotational movement of the actuation disk 162 to that arc. As may be best viewed in FIG. 17, when the actuation disk 162 is rotated to the locking position, the tab 172 is near or abuts a first wall 206A of the aperture 156. Conversely, as may be best viewed in FIG. 25, when the actuation disk 162 is rotated to the locking position, the tab 172 is near or abuts a second wall 206B of the aperture 156. The aperture 156 is further configured to permit the tab 172 to move along the arc between the two walls 206A, 206B.

The aperture 156 is further configured to provide for two resilient arms 204A, 204B formed in the lid cover 16. Each resilient arm 204A, 204B is operative to snap-lock the tab 172 in a respective recess 208A, 208B of the resilient arm. The application of increased rotational force on the actuation disk 162 is required to move the tab 172 into and out of each recess 208A, 208B. After freeing the tab 172 from a resilient arm 204A, 204B, the tab 172 may be moved more easily between the resilient arms 204A, 204B. The resilient arms 204A, 204B have the effect of retaining the actuation disk 162 in the locking or unlocking positions until the rotational force applied to the actuation disk 162 is strong enough to exceed a threshold. Accordingly, the resilient arms 204A, 204B may reduce the likelihood of accidental or unintentional rotation of the first locking mechanism and opening of the lid cover 16.

A second locking mechanism is used for releasably securing the cover 16 to the body 12 of the lid 10. As shown in FIGS. 9 and 10, two pivot pin apertures 216A, 216B are provided in opposing walls defining an exteriorly opening front recess 215A in the exterior wall 122 of the lid cover 16. The two pivot pin apertures 216A, 216B are configured to rotatably receive two pivot pins 214A, 214B of a button plate 212 positioned in an upper portion within the recess 215A. A lower portion of the button plate 212 is positioned in an exteriorly opening front recess 215B in the main body 12 of the lid 10, immediately below the recess 215A when the lid is closed. An interior surface 218 of the button plate 212 has disposed thereon an inwardly projecting tongue portion 220 at a location below the hinge line defined by the two pivot pins 214A, 214B and configured to be received within a pocket 194 of the main body 12 of the lid 10 located within the recess 215B for locking the lid 10 when closed. The interior surface 218 of the plate 212 is also configured for receiving a compression spring 222 at a location above the hinge line of the pins 214A, 214B and above the tongue portion 220. A second end of the compression spring 222 is received by the lid cover 16. The button plate 212 fits within the combined recess formed by the recess 215A and 215B when the lid 10 is closed. When the second locking mechanism is assembled, manual pressure exerted inward on the plate 212 causes the compression spring 222 to become compressed thus drawing the tongue portion 220 out of the pocket 194 and causing the second locking mechanism to be actuated to the unlocking position. The inwardly projecting tongue portion 220 is configured such that the manual rotation of the lid cover 16 downward about the hinge mechanism 13 to close the lid cover causes the tongue portion 220 to be received within the pocket 194 of the main body 12 of the lid 10 so as to securely lock the lid 10 in the closed position.

As described herein, the lid cover 16 can only be rotated to the open position upon actuation of the second locking mechanism if the actuation disk 162 of the first locking mechanism is rotated to the unlocking position. In other words, both the first and second locking mechanisms must be moved to its unlocking position for the lid 10 to be moved from the closed position to the open position. Although the button plate 212 of the second locking mechanism is described herein as being pivoted on the cover 16, it may be contemplated that the plate 212 is pivoted on the body 16 of the lid 10 for releasably securing the cover 16 of the lid 10 to the body 12 of the lid 10.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

What is claimed is:

1. A lid for use with a drinking vessel containing a liquid, comprising:

a body selectively couplable to the drinking vessel, the body including an upper portion having an opening configured to permit fluid passage therethrough when the lid is coupled to the drinking vessel; and a cover rotatably coupled to the body and operative to rotatably transition between a closed position wherein the cover is engaged with the body to prevent the liquid from exiting the drinking vessel through the opening and an open position wherein the cover is spaced apart from the body to allow fluid passage through the opening, the cover comprising:

a first locking mechanism including an actuation disk rotatable between a locking position and an unlocking position, the actuation disk having a first locking member preventing the cover from transitioning from the closed position to the open position when the actuation disk is in the locking position, and permitting the cover to transition from the closed position to the open position when the actuation disk is in the unlocking position, a second locking mechanism including a second locking member holding the cover in the closed position and operable to permit transition of the cover from the closed position to the open position when the actuation disk is in the unlocking position, an upper portion with an aperture, the actuation disk being disposed above the upper portion and extending over the aperture, the first locking member being disposed below the upper portion, and the actuation disk and the first locking member being operatively connected together for rotation as a unit by a connector member extending through the aperture such that rotation of the actuation disk from the locking position to the unlocking position moves the first locking member from a first position preventing the cover from transitioning from the closed position to the open position to a second position permitting the cover to transition from the closed position to the open position.

2. The lid of claim 1, wherein the body includes a stop and the first locking member includes a lock member, when the actuation disk is in the locking position the lock member is positioned to engage the stop and thereby prevent upward movement of the cover from the closed position to the open position, and when the actuation disk is in the unlocking position the lock member is positioned to disengage the stop and thereby permit upward movement of the cover from the closed position to the open position.

3. The lid of claim 2, wherein the lock member rotates with the actuation disk as the actuation disk rotates between the locking position and the unlocking position, the lock member extending under the stop when the actuation disk is in the locking position, and is positioned out from under the stop when the actuation disk is in the unlocking position.

4. The lid of claim 2, wherein the second locking mechanism of the lid includes a press button operable to move the second locking member from a first position holding the cover in the closed position to a second position permitting transition of the cover from the closed position to the open position when the actuation disk is in the unlocking position.

5. The lid of claim 4, wherein body includes a second stop and the press button includes a second lock member, when the second locking member is in the first position the press button is positioned with the second lock member in position to engage the second stop and thereby prevent upward movement of the cover from the closed position to the open position, and when second locking member is in the second position the press button is positioned with the second lock member in position to disengage the second stop and thereby permit upward movement of the cover from the closed position to the open position.

6. The lid of claim 5, wherein when the second locking member is in the first position the second lock member extends under the second stop, and when the second locking member is in the second position the second lock member is positioned out from under the second stop.

7. The lid of claim 5, wherein the body includes a recess wherein the second stop is located, and the second lock member is positioned within the recess for engagement with the second stop when the second locking member is in the first position, and withdrawn from the recess sufficiently when the second locking member is in the second position to not engage the second stop when the cover is transitioned from the closed position to the open position.

8. The lid of claim 7, wherein the press button is pivotally attached to a wall portion of the cover for pivotal movement about a hinge line above the second lock member.

9. The lid of claim 1, wherein the second locking mechanism of the lid includes a press button operable to move the second locking member from a first position holding the cover in the closed position to a second position permitting transition of the cover from the closed position to the open position when the actuation disk is in the unlocking position.

10. The lid of claim 9, wherein body includes a stop and the press button includes a lock member, when the second locking member is in the first position the press button is positioned with the lock member in position to engage the stop and thereby prevent upward movement of the cover from the closed position to the open position, and when the second locking member is in the second position the press button is positioned with the lock member in position to disengage the stop and thereby permit upward movement of the cover from the closed position to the open position.

11. The lid of claim 10, wherein when the second locking member is in the first position the lock member extends under the stop, and when the second locking member is in the second position the lock member is positioned out from under the stop.

12. The lid of claim 10, wherein the body includes a recess wherein the stop is located, and the lock member is positioned within the recess for engagement with the stop when the second locking member is in the first position, and withdrawn from the recess sufficiently when the second locking member is in the second position to not engage the stop when the cover is transitioned from the closed position to the open position.

13. The lid of claim 12, wherein the press button is pivotally attached to a wall portion of the cover for pivotal movement about a hinge line above the lock member.

14. The lid of claim 9, wherein the cover includes a recess, and the press button is at least partially positioned within the recess.

15. The lid of claim 14, wherein the recess has opposing walls, each of the opposing walls having a pivot pin aperture, and the press button has a pair of oppositely extending pivot pins, each of the pivot pins being received within a different one of the pivot pin apertures.

16. The lid of claim 1, wherein a drinking opening plug is disposed on an interior surface of the cover, and the drinking opening plug is configured to seal the opening of the upper portion of the body when the cover is in the closed position.

17. A drinking vessel and lid assembly, comprising:

a drinking vessel;

a lid selectively couplable to the drinking vessel, the lid having a body, the body having an upper portion configured with an opening to permit fluid passage therethrough when the lid is coupled to the drinking vessel, the lid having a cover rotatably coupled to the body and operative to rotatably transition between a closed position wherein the cover is engaged with the body to prevent fluid from exiting the drinking vessel through the opening and an open position wherein the cover is spaced apart from the body to allow fluid passage through the opening;

the lid being configured with a locking mechanism including an actuation member rotatable between a locking position and an unlocking position, the cover being operative to transition from the closed position to the open position on a condition that the actuation member is in the unlocking position, the cover being held in the closed position when the actuation member is in the locking position; and an other locking mechanism holding the cover in the closed position when in an other locking mechanism locking position and operable to permit transition of the cover from the closed position to the open position when both the actuation member is rotated into the unlocked position and the other locking mechanism is moved to an other locking mechanism unlocking position, the other locking mechanism including a press-lock button operable to move the other locking mechanism from the other locking mechanism locking position to the other locking mechanism unlocking position.

18. A lid for use with a drinking vessel containing a liquid, comprising:

a body selectively couplable to the drinking vessel, the body including an upper portion having an opening configured to permit fluid passage therethrough when the lid is coupled to the drinking vessel; and a cover rotatably coupled to the body and operative to rotatably transition between a closed position wherein the cover is engaged with the body to prevent the liquid from exiting the drinking vessel through the opening and an open position wherein the cover is spaced apart from the body to allow fluid passage through the opening, the cover comprising:

a first locking mechanism including a manually rotatable actuator rotatable between a locking position and an unlocking position, the actuator having a first locking member preventing the cover from transitioning from the closed position to the open position when the actuator is in the locking position, and permitting the cover to transition from the closed position to the open position when the actuator is in the unlocking position, a second locking mechanism including a second locking member holding the cover in the closed position and operable to permit transition of the cover from the closed position to the open position when the actuator is in the unlocking position, an upper portion with an aperture, the actuator being disposed above the upper portion and extending over the aperture and the first locking member being disposed below the upper portion, and a connector member extending through the aperture and operatively connecting together the actuator and the first locking member for rotation as a unit such that rotation of the actuator from the locking position to the unlocking position moves the first locking member from a first position preventing the cover from transitioning from the closed position to the open position to a second position permitting the cover to transition from the closed position to the open position.

19. The lid of claim 18, wherein the body includes a stop and the first locking member includes a lock member, when the actuator is in the locking position the lock member is positioned to engage the stop and thereby prevent upward movement of the cover from the closed position to the open position, and when the actuator is in the unlocking position the lock member is positioned to disengage the stop and thereby permit upward movement of the cover from the closed position to the open position.

20. A lid for use with a drinking vessel containing a liquid, comprising:

a body selectively couplable to the drinking vessel, the body including an upper portion having an opening configured to permit fluid passage therethrough when the lid is coupled to the drinking vessel;

a locking mechanism including an actuation member rotatable between a locking position and an unlocking position; and a cover rotatably coupled to the body and operative to rotatably transition between a closed position wherein the cover is engaged with the body to prevent the liquid from exiting the drinking vessel through the opening and an open position wherein the cover is spaced apart from the body to allow fluid passage through the opening, the cover being operative to transition from the closed position to the open position on a condition that the actuation member is in the unlocking position, the cover being held in the closed position when the actuation member is in the locking position, the cover further including:

an upper wall with an aperture and the actuation member disposed above the upper wall over the aperture, a support member disposed below the upper wall and supporting the locking mechanism for rotation therewith, and a connector member extending through the aperture and having an upper end portion attached to the actuation member and a lower end portion attached to the support member, and configured for rotation of the actuation member from the locking position to the unlocking position moving the locking mechanism from a first position preventing the cover from transitioning from the closed position to the open position to a second position permitting the cover to transition from the closed position to the open position.

21. The lid of claim 20, further including an other locking mechanism holding the cover in the closed position when in an other locking mechanism locking position and operable to permit transition of the cover from the closed position to the open position when both the actuation member is rotated into the unlocked position and the other locking mechanism is moved to an other locking mechanism unlocking position.

22. The lid of claim 21, wherein the other locking mechanism including a press-lock button operable to move the other locking mechanism from the other locking mechanism locking position to the other locking mechanism unlocking position.

23. The lid of claim 20, wherein the actuation member is an actuation disk rotatable in a plane transverse to a longitudinal axis of the lid.

24. A lid for use with a drinking vessel containing a liquid, comprising:

a body selectively couplable to the drinking vessel, the body including an upper portion having an opening configured to permit fluid passage therethrough when the lid is coupled to the drinking vessel;

a first locking mechanism including an actuation member rotatable between a locking position and an unlocking position, and a first locking member operatively coupled to the actuation member; and a cover rotatably coupled to the body and operative to rotatably transition between a closed position wherein the cover is engaged with the body to prevent the liquid from exiting the drinking vessel through the opening and an open position wherein the cover is spaced apart from the body to allow fluid passage through the opening, the cover being operative to transition from the closed position to the open position on a condition that the actuation member is in the unlocking position, the cover being held in the closed position when the actuation member is in the locking position, the cover further including:

an upper portion with an aperture, the actuation member disposed above the upper portion and extending over the aperture and the first locking member being disposed below the upper portion, and a connector member extending through the aperture and operatively connecting together the actuation member and the first locking member for rotation as a unit such that rotation of the actuation member from the locking position to the unlocking position moves the first locking member from a first position preventing the cover from transitioning from the closed position to the open position to a second position permitting the cover to transition from the closed position to the open position.

25. The lid of claim 24, further including a second locking mechanism holding the cover in the closed position when in a second locking mechanism locking position and operable to permit transition of the cover from the closed position to the open position when both the actuation member is rotated into the unlocked position and the second locking mechanism is moved to a second locking mechanism unlocking position.

26. The lid of claim 25, wherein the second locking mechanism including a press-lock button operable to move the second locking mechanism from the second locking mechanism locking position to the second locking mechanism unlocking position.

27. The lid of claim 24, wherein the actuation member is an actuation disk rotatable in a plane transverse to a longitudinal axis of the lid.

* * * * *